US010487657B2

(12) United States Patent
Mathers et al.

(10) Patent No.: US 10,487,657 B2
(45) Date of Patent: Nov. 26, 2019

(54) HYDRAULIC MACHINE

(71) Applicant: Mathers Hydraulics Technologies Pty Ltd, Bridgeman Downs (AU)

(72) Inventors: Norman Ian Mathers, Brisbane (AU); Robert Price, Brisbane (AU)

(73) Assignee: Mathers Hydraulics Technologies Pty Ltd, Bridgeman Downs (AU)

( * ) Notice: Subject to any disclaimer, the term of this patent is extended or adjusted under 35 U.S.C. 154(b) by 82 days.

(21) Appl. No.: 15/561,410

(22) PCT Filed: Mar. 24, 2016

(86) PCT No.: PCT/AU2016/000108
§ 371 (c)(1),
(2) Date: Sep. 25, 2017

(87) PCT Pub. No.: WO2016/149740
PCT Pub. Date: Sep. 29, 2016

(65) Prior Publication Data

US 2018/0106152 A1 Apr. 19, 2018

Related U.S. Application Data

(60) Provisional application No. 62/138,734, filed on Mar. 26, 2015.

(51) Int. Cl.
*F01C 1/344* (2006.01)
*F01C 21/08* (2006.01)
(Continued)

(52) U.S. Cl.
CPC ..... *F01C 1/3446* (2013.01); *F01C 21/08* (2013.01); *F01C 21/104* (2013.01);
(Continued)

(58) Field of Classification Search
CPC ..... F01C 1/3446; F04C 14/20; F04C 2/3446; F04C 14/223
See application file for complete search history.

(56) References Cited

U.S. PATENT DOCUMENTS 2,570,411 A 10/1951 Vickers
3,792,585 A 2/1974 Eisenmann et al.
(Continued)

FOREIGN PATENT DOCUMENTS

CN 1853031 A 10/2006
CN 101081596 A 12/2007
(Continued)

OTHER PUBLICATIONS

"Chinese Application Serial No. 20168003037.1, Voluntary Amendment filed", with English translation of claims, 10 pgs.
(Continued)

*Primary Examiner* — Thomas E Lazo
(74) *Attorney, Agent, or Firm* — Schwegman Lundberg & Woessner, P.A.

(57) ABSTRACT

A hydraulic device can include two or more rings, a rotor having a plurality of vanes, and an adjuster. The two or more rings can be rotatably mounted within the hydraulic device and arranged adjacent one another configured for relative rotation with respect to one another. The rotor can be disposed for rotation about an axis within the two or more rings and can have a plurality of circumferentially spaced slots, each slot having at least one of the plurality of vanes located therein. The plurality of vanes can be configured to be movable between a retracted position and an extended position where the plurality of vanes work a hydraulic fluid introduced adjacent to the rotor. The adjuster can be configured to translate linearly to rotatably position the two or more rings relative to one another to increase or decrease a
(Continued)

displacement of the hydraulic fluid between the rotor and the two or more rings.

21 Claims, 15 Drawing Sheets

(51) Int. Cl.

| | |
|---|---|
| ***F01C 21/10*** | (2006.01) |
| ***F04C 2/344*** | (2006.01) |
| ***F04C 14/22*** | (2006.01) |
| ***F04C 14/20*** | (2006.01) |
| *F03C 2/30* | (2006.01) |

(52) U.S. Cl.

CPC ..... *F04C 2/3446* (2013.01); *F04C 14/20* (2013.01); *F04C 14/223* (2013.01); *F01C 21/0836* (2013.01); *F01C 21/0854* (2013.01); *F03C 2/304* (2013.01); *F04C 2230/91* (2013.01)

(56) References Cited

U.S. PATENT DOCUMENTS

| | | | | |
|---|---|---|---|---|
| 4,406,599 | A * | 9/1983 | Stephan | F01C 21/0809 418/22 |
| 4,646,521 | A | 3/1987 | Snyder | |
| 4,659,297 | A | 4/1987 | Kahrs | |
| 5,657,629 | A * | 8/1997 | Folsom | F04C 14/20 60/487 |
| 7,955,062 | B2 | 6/2011 | Mathers | |
| 8,584,452 | B2 | 11/2013 | Lloyd et al. | |
| 8,597,002 | B2 | 12/2013 | Mathers | |
| 8,691,063 | B2 | 4/2014 | Aleksandrov | |
| 8,708,679 | B2 | 4/2014 | Mathers | |
| 2004/0136853 | A1 | 7/2004 | Clements et al. | |
| 2006/0133946 | A1 | 6/2006 | Mathers | |
| 2009/0280021 | A1 | 11/2009 | Mathers | |
| 2010/0028641 | A1* | 2/2010 | Zhu | C23C 14/0605 428/220 |
| 2010/0154402 | A1 | 6/2010 | Cho | |
| 2013/0067899 | A1* | 3/2013 | Mathers | F16D 33/00 60/327 |
| 2014/0291045 | A1 | 10/2014 | Collett et al. | |
| 2018/0010676 | A1 | 1/2018 | Mathers et al. | |

FOREIGN PATENT DOCUMENTS

| | | | |
|---|---|---|---|
| CN | 102753851 | A | 10/2012 |
| CN | 103052796 | A | 4/2013 |
| CN | 103758976 | A | 4/2014 |
| CN | 103836093 | | 6/2014 |
| CN | 107428241 | A | 12/2017 |
| CN | 107709704 | | 2/2018 |
| EP | 0051192 | A1 | 5/1982 |
| EP | 1536138 | | 6/2005 |
| EP | 1536138 | A1 | 6/2005 |
| IN | 201717028529 | A | 10/2017 |
| IN | 201717036365 | A | 12/2017 |
| WO | WO-2005005782 | A1 | 1/2005 |
| WO | WO-2006119574 | A1 | 11/2006 |
| WO | WO-2007140514 | A1 | 12/2007 |
| WO | WO-2012015850 | A1 | 2/2012 |
| WO | WO-2016116809 | A1 | 7/2016 |
| WO | 2016149740 | | 9/2016 |

OTHER PUBLICATIONS

"European Application Serial No. 16767517.2, Extended European Search Report dated Oct. 8, 2018", 6 pgs.
"European Application Serial No. 16739836.1, Extended European Search Report dated Sep. 6, 2018", 5 pgs.
"European Application Serial No. 16767517.2, Response filed May 7, 2018 to Communication pursuant to Rules 161(2) and 162 EPC, dated Nov. 7, 2017", 13 pgs.
"U.S. Appl. No. 15/544,829, Preliminary Amendment, Jul. 19, 2017", 3 pgs.
"European Application Serial No. 16739836.1, Response filed Feb. 23, 2018", 8 pgs.
"International Application Serial No. PCT/IB2016/000090, International Preliminary Report on Patentability dated Aug. 3, 2017", 6 pgs.
"International Application Serial No. PCT/IB2016/000090, International Search Report dated May 2, 2016", 4 pgs.
"International Application Serial No. PCT/IB2016/000090, Written Opinion dated May 2, 2016", 4 pgs.
"International Application Serial No. PCT/AU2016/000108, International Preliminary Report on Patentability dated Oct. 5, 2017", 8 pgs.
"International Application Serial No. PCT/AU2016/000108, Written Opinion dated Jun. 7, 2016", 6 pgs.
"International Application Serial No. PCT/AU2016/000108, International Search Report dated Jun. 7, 2016", 7 pgs.
"European Application Serial No. 16739836.1, Response Filed Jan. 11, 2019 to Extended European Search Report dated Sep. 6, 2018", 23 pgs.
"European Application Serial No. 16767517.2, Response Filed Apr. 29, 2019 to Extended European Search Report dated Oct. 8, 2018", 56 pgs.
U.S. Appl. No. 15/544,829, filed Jan. 18, 2016, Hydro-Mechanical Transmission With Multiple Modes of Operation.
"Chinese Application Serial No. 201680030371.1, Office Action dated May 30, 2019", with English translation of claims, 9 pgs.
"Chinese Application Serial No. 201680012390.1, Office Action dated Jun. 17, 2019", w/ English translation, 25 pgs.

* cited by examiner

HYDRAULIC MACHINE

PRIORITY CLAIM

This application is a U.S. National Stage Filing under 35 U.S.C. § 371 of International Patent Application Serial No. PCT/AU2016/000108, filed Mar. 24, 2016, and published on Sep. 29, 2016 as WO2016/149740, which claims the benefit of priority to U.S. Provisional Application Ser. No. 62/138,734, filed Mar. 26, 2015, the benefit of priority of each of which is claimed hereby and each of which are incorporated by reference herein in their entirety.

CROSS REFERENCE TO RELATED APPLICATIONS

The present application is related to international application no. PCT/AU2007/000772, publication no. WO/2007/140514, entitled, "Vane Pump for Pumping Hydraulic Fluid," filed Jun. 1, 2007; international application no. PCT/AU2006/000623, publication no. WO2006/119574, entitled, "Improved Vane Pump," filed May 12, 2006; international application no. PCT/AU2004/00951 publication no. WO/2005/005782, entitled, "A Hydraulic Machine," filed Jul. 15, 2004, U.S. patent application Ser. No. 13/510,643, publication no. US 2013/0067899, entitled "Hydraulically Controlled Rotator Couple," filed Dec. 5, 2012, and U.S. Patent Application Ser. No. 62/104,975, entitled "Vehicle System Including Hydro-Mechanical Transmission With Multiple Modes et Operation", filed Jan. 19, 2015, the entire specification of each of which is incorporated herein by reference in entirety.

TECHNICAL FIELD

The present patent application relates generally to hydraulic devices, and more particularly, to variable vane hydraulic machines that include a plurality of rings that can be rotated to vary displacement.

BACKGROUND

Hydraulic vane pumps are used to pump hydraulic fluid in many different types of machines for different purposes. Such machines include, for example, transportation vehicles, agricultural machines, industrial machines, and marine vehicles (e.g., trawlers).

Hydraulic vane pumps are usually coupled to a drive, such as to a rotating output shaft of a motor or an engine and, it the absence of expensive space invasive clutches or other disconnecting means, continue to pump hydraulic fluid as long as the motor or engine continues to operate. A rotor of the pump usually has a rotational speed determined by the rotational speed of the motor or engine.

One known limit to improving the pressure and speed Capability of vane pumps is the out-of-balance forces applied to the under-vane regions in the mid quadrant. In this regard, hydraulic vane pumps typically have an inlet located at the start of the rise region. The inlets supply low pressure hydraulic fluid to the rise region. As the vanes move the oil through the rise region, into the major dwell and then into the fall region, the oil becomes pressurized. The pressurized oil leaves via outlets associated with each fall region of the pump.

Rotary couplings are also utilized in transportation vehicles, industrial machines, and agricultural machines to transmit rotating mechanical power. For example, they have been used in automobile transmissions as an alternative to a mechanical clutch. Use of rotary couplings is also widespread in applications where variable speed operation and controlled start-up without shock loading of the power transmission system is desired.

My currently pending application U.S. patent application Ser. No. 13/510,643, describes a hydraulically controllable coupling configured to couple a rotating input to an output to rotate. The coupling can also decouple the input from the output by switching the hydraulic device such as a vane pump between a pumping mode and a mode in which it does not pump. Currently pending application U.S. Patent Application Ser. No. 62/104,975 also describes systems and methods using a plurality of hydraulic devices each configured to be operable as a hydraulic coupling and as a vane pump.

Overview

Hydraulic devices are disclosed herein including a variable vane hydraulic device that utilizes rings and an adjuster to rotate the rings relative to one another to vary hydraulic displacement of the device. According to some examples, the hydraulic device with the rotating rings and adjuster can be used to change hydraulic displacement such as with a variable vane pump. In other examples, the hydraulic device with the rotating rings and adjuster can be used as a hydrostatic coupling to facilitate torque transfer (i.e. couple a rotating input to an output to rotate, decouple the input from the output). In further examples, the hydraulic device with the rotating rings and adjuster can be used as both the variable vane pump and as the hydrostatic coupling, and can have a variable displacement.

The present inventors have recognized that variable vane hydraulic devices can offer improved power density and service life as compared to traditional variable piston pump/motor hydraulic devices. Such traditional variable piston hydraulic devices can be larger per flow rate than variable vane hydraulic devices, making them difficult to fit in smaller engine bays. Furthermore, the present inventors m have recognized that variable piston hydraulic devices take rotary energy and transfer it to axial energy then to pressurized hydraulic flow to do work. Such conversions result in power loss. In contrast, a variable vane hydraulic device can convert rotary energy directly to pressurized flow reducing the number of conversions, and hence, the number of power losses.

The present inventors have also recognized that variable vane hydraulic devices can be incorporated into vehicle systems to improve energy efficiency by allowing excess energy generated during the vehicle's operation to b used for hydraulic function or stored for later use/power regeneration. The efficiency increases provided by the vehicle systems can allow lower power rated engines to be used. By controlling the torque requirement of the engine, the engine management system can have a far better chance of offering fuel efficiency and can reduce fuel usage and emissions. The present inventors have also recognized that the use of the hydraulic device with the rotating rings and adjuster capable of operation as a vane pump and torque coupling, allows for tandem system operation such as hybrid pumping and drive that can increase efficiency, reduced fuel usage, and emmissions.

According to one example, a hydraulic device can include two or more rings, a rotor having a plurality of vanes, and an adjuster. The two or more rings can be rotatably mounted within the hydraulic device and arranged adjacent one another configured for relative rotation with respect to one another. The rotor can be disposed for rotation about an axis within the two or more rings and can have a plurality of circumferentially spaced slots, each slot having at least one of the plurality of vanes located therein. The plurality of vanes can be configured to be movable between a retracted position and an extended position where the plurality of vanes work a hydraulic fluid introduced adjacent the rotor. The adjustor can be configured to translate linearly to rotatably position the two or more rings relative to one another to increase or decrease a displacement of the hydraulic fluid between the rotor and the two or more rings.

Additional examples contemplate that the fluid communicating interior portions of the device and other system components including, for example, the rotor, vanes, rings, the adjuster, the plurality of accessories, and the transmission can be coated in a diamond or diamond-like carbon as will be discussed subsequently. This can allow more environmentally friendly hydraulic fluids such as glycol to be used by the system.

The hydraulic devices described herein can provide for a variable displacement, and thus, can be utilized with various systems such as those described in U.S. patent application Ser. No. 62/104,975 the disclosure of which is incorporated by reference. The hydraulic devices described herein can be used with various accessories including a hydraulic pump motor, an accumulator, and various vehicle auxiliary systems and can be utilized as part of systems that have various operation modes including tandem torque amplifying wheel drive mode, a tandem steady state wheel drive mode, a tandem vane pumping mode, a regenerative energy storage mode, and a regenerative energy application mode as described in U.S. Patent Application Ser. No. 62/104,975, The devices can provide operational flexibility, being selectively non-operable, selectively operable as only a vane pump (e.g., in a maximum pump mode), operable as only a hydraulic coupling (e.g., in a maximum drive mode), operable as both a vane pump and a hydraulic coupling to in a variable pump and drive mode), and operable as a vane pump with a variable displacement (e.g., in a variable displacement mode).

As used herein the tetrad "vehicle" means virtually all types of vehicles such as earth moving equipment (e.g., wheel loaders, mini-loaders, backhoes, dump trucks, crane trucks, transit mixers, etc.), waste recovery vehicles, marine vehicles, industrial equipment (e.g., agricultural equipment), personal vehicles, public transportation vehicles, and commercial road vehicles (e.g., heavy road trucks, semi-trucks, etc.).

These and other examples and features of the present devices, systems, and methods will be set forth in part in the following Detailed Description. This overview is intended to provide a summary of subject matter of the present patent application. It is not intended to provide an exclusive or exhaustive removal of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present application relates to a variable vane hydraulic device that utilizes rings and an adjuster to rotate the rings relative to one another to vary hydraulic displacement of the deice. Such hydraulic devices can comprise variable yule pump/motor devices, for example. According to further examples the hydraulic devices can comprise variable vane devices that are operable as vane pumps/motors and as hydraulic couplings. Vehicle systems are also disclosed that can utilize the variable vane hydraulic devices along with other accessories to operate in various operation modes.

Figure 1:
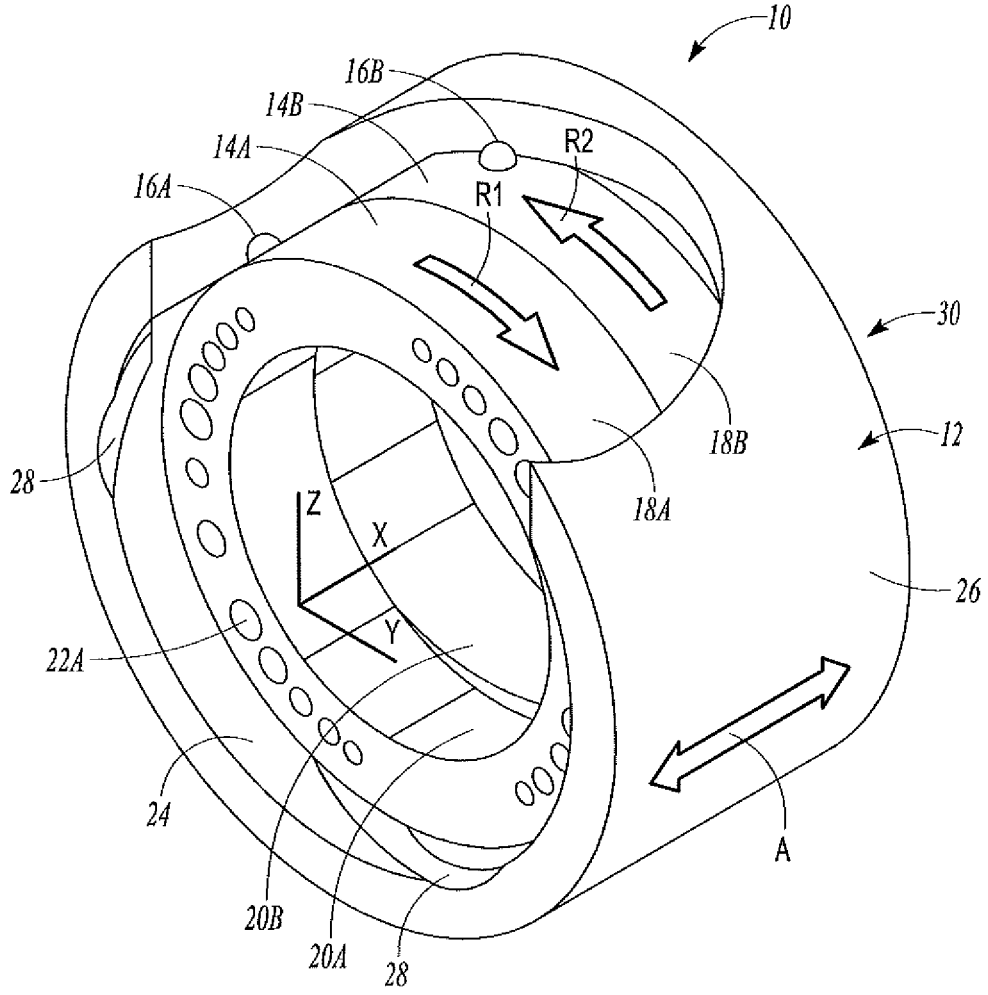
FIG. 1 is a perspective view a portion of a hydraulic device comprising a pair of rings and an adjuster according to an example of the present application.

FIG. 1 shows a perspective view of a portion of a hydraulic device 10 including an adjuster 12, rings 14A and 14B, and bearings 16A and 16B. The first ring 14A includes an outer surface 18A, an inner surface 20A, and passages 22A. The second ring 14B includes an outer surface 18B, inner surface 20B, and passages (not shown). The adjuster 12 includes an inner surface 24, an outer surface 26, and grooves 28.

Each ring 14A and 14B can define an inner cavity adapted to house a rotor (not shown) therein. The inner cavity can also be configured to allow a space for a hydraulic fluid to be introduced adjacent the rotor in a space between the rotor and the inner surfaces 20A and 20B of the rings 14A and 14B). The passages 22A and 22B (22B shown in FIG. 2) extend through each ring 14A and 14B and can also define a path for the hydraulic fluid to flow between the rings 14A and 14B.

In the example of FIG. 1, the adjuster 12 comprises a sleeve 30 adapted to receive the first and second rings 14A and 14B therein. Although only two rings are shown in the example of FIG. 1, further examples can include three or more rings. In FIG. 1, a portion of the sleeve 30 is removed to illustrate the bearings 16A and 16B and the relative rotation of the first and second rings 14A and 14B.

As shown in FIG. 1, the first and second rings 14A and 14B are disposed adjacent one another and are disposed along an axis X within the adjuster 12. The bearings 16A and 16B are disposed at the outer surfaces 18A and 18B of the rings 14A and 14B, respectively. The bearings 16A and 16B can extend from the outer surfaces 18A and 18B and are received by the interfacing inner surface 24 of the adjuster 12. More particularly, the adjuster 12 is configured with grooves 28 (also called tracks), or guides extending along the inner surface 24 of the adjuster 12. The grooves 28 are configured to receive the bearings 16A and 16B therein.

According to the example of FIG. 1, the rings 14A and 14B are configured for relative rotation with respect to one another. Such rotation can include rotation in opposing directions as indicated by arrows R1 and R2. In other examples, at least one ring can be stationary while the second and subsequent rings can be rotated relative thereto.

The adjuster 12 is configured to move such as in a transverse generally linear direction relative to the rings 14A and 14B as indicated by arrow A. As will be discussed subsequently, movement of the adjuster 12 (e.g., the sleeve 30) can rotatably position the rings 14A and 14B relative to one another to increase or decrease a displacement of a hydraulic fluid between a rotor (not shown) and the rings 14A and 14B.

As shown in the example of FIG. 1, the inner surfaces 20A and 20B of the first and second rings 14A and 14B are generally elliptically shaped in cross-section, while the outer surfaces 18A and 18B of the first and second rings 14A and 14B are generally circular in cross-section. Thus, the sleeve 30 can have a variable thickness in cross-section. Due to the shape of the inner surfaces 20A and 20B (symmetry only when rotated to certain positions relative to one another), when the rings 14A and 14B can be registered and unregistered relative to each other by the relative rotation. Put another way, the positions of the rings 14A and 14B can be variable with respect to one another to change the relative volume defined between portions of ring 14A and 14B with respect to the rotor (not shown).

More particularly, as the rings 14A and 14B are rotated relative to one another, the inner surfaces 18A and 18B can be brought into and out of substantial alignment with one another. Such alignment and non-alignment may be referred to as in-phase and out-of-phase herein. According to some examples, such as those shown in FIGS. 2-2C and 5A, one position of the rings 14A and 14B can include a fully registered position where the inner surfaces 20A and 20B of the rings 14A and 14B are in-phase with one another so that the inner surfaces 20A and 20B substantially align. Another position of the rings 14A and 14B can comprise a fully unregistered position (shown in FIGS. 3-3C and 5B) where the inner surfaces 20A and 20B of the rings 14A and 14B are out-of-phase with one another and do not align. According to further examples, such as those of FIGS. 1 and 4-4C, the rings 14A and 14B are capable of positions that are variable with respect to one another between the fully registered position and the fully unregistered position. As will be discussed subsequently, such variable displacement or intermediate positions can allow the hydraulic device to act as a pump and as a hydraulic coupling according to some examples. The variable displacement or intermediate position can also increment displacement as desired such that a desired amount of hydraulic flow suitable for the task required is pumped. In this manner, the disclosed arrangement reduces or eliminates situations where an excessive hydraulic flow is produced. Thus, the disclosed arrangement reduces or eliminates production of excessive hydraulic flow, which can be wasteful and inefficient.

Figure 2:
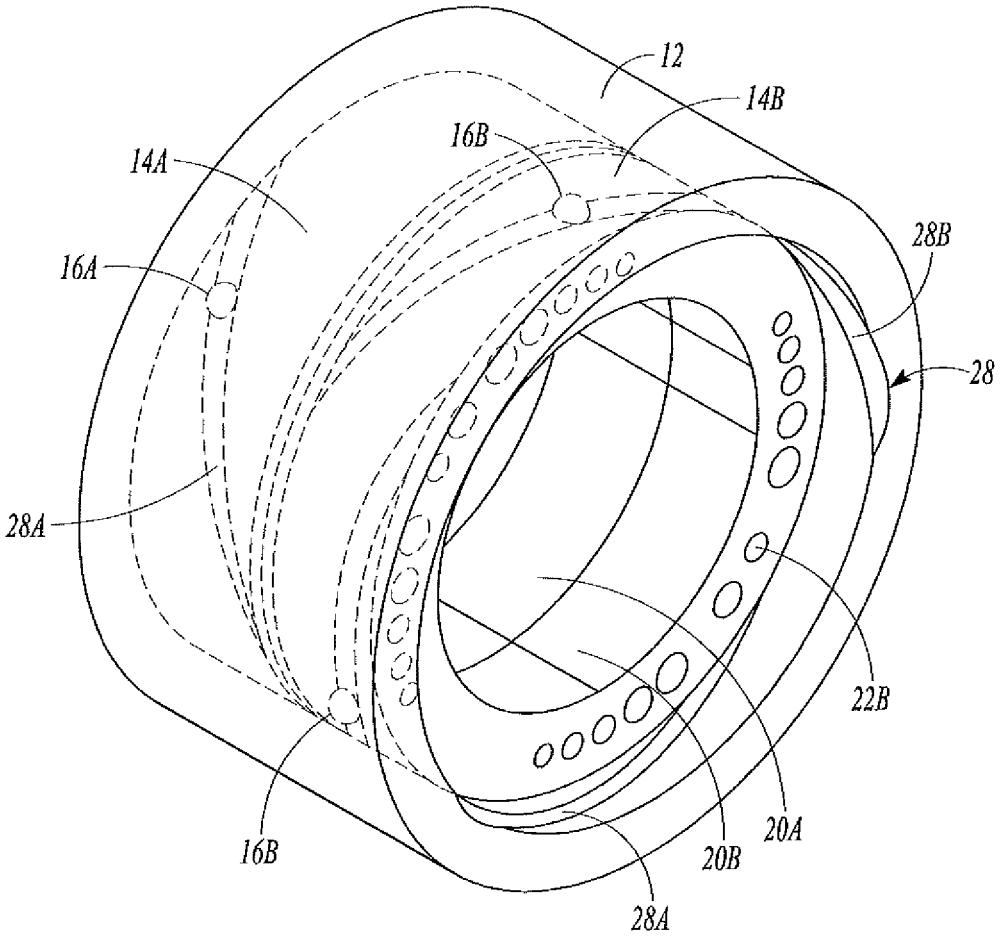
FIGS. 2-2C are views of the adjuster and the rings of FIG. 1 with the rings disposed in a fully registered position according to an example of the present application.
Figure 2A:
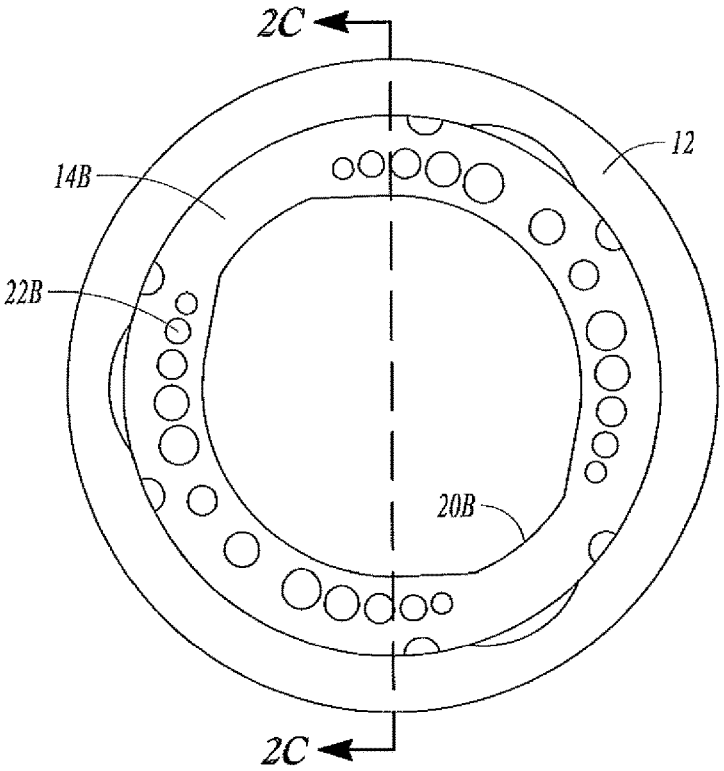
Figure 2B:
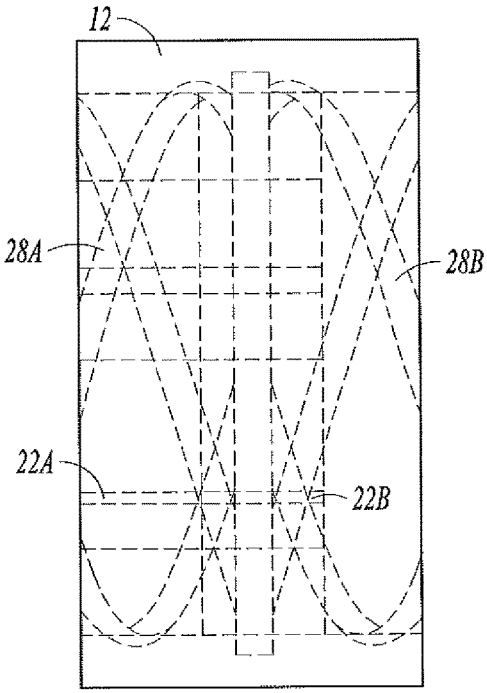
Figure 2C:
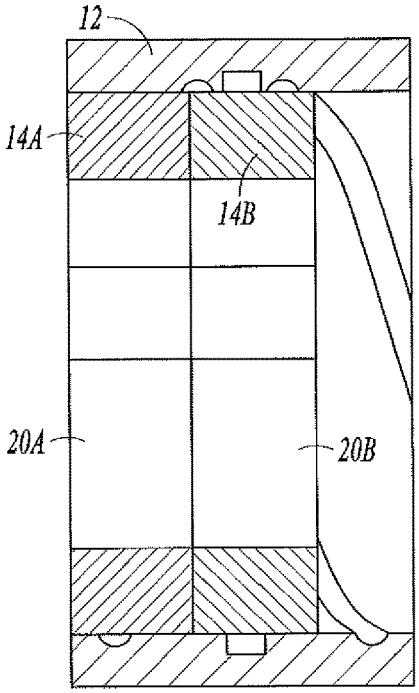

FIGS. 2-2C show the rings 14A and 14B disposed in the fully registered position with respect to each other within the adjuster 12. FIG. 2 shows the rings 14A and 14B and adjuster 12 in a perspective view. FIG. 2A is an end view showing the ring 14B, adjuster 12, as well as passages 22B. FIG. 2B shows a side view of the adjustor 12 with the rings 14A and 14B shown in phantom. FIG. 2C is a cross-section of the adjuster 12 and rings 14A and 14B.

FIG. 2 illustrates the ring 14B can include passages 22B and also shows the groove 28 can include a first groove 28A and a second groove 28B. The first groove 28A and the second groove 28B can be spaced apart with the first groove 28A helically extending in a first direction and the second groove 28B helically extending in an opposing helical direction. Due to the opposing helical extents of the first groove 28A and the second groove 28B, the first ring 14A is rotatable in a first direction and the second ring 14B is rotatable in a second direction opposite the first direction with movement of the adjuster 12.

As shown in the example of FIGS. 2-2C, in the fully registered position the inner surface 20B of the second ring 14B generally aligns with the inner surface 20A of the first ring 14A. As shown in FIG. 2B, in the fully registered position the passages 22A of the first ring 14A can substantially align with the passages 22B of the second ring 14B. FIG. 2B also illustrates the first groove 28A and the second groove 28B as discussed in reference to FIG. 2.

Figure 3:
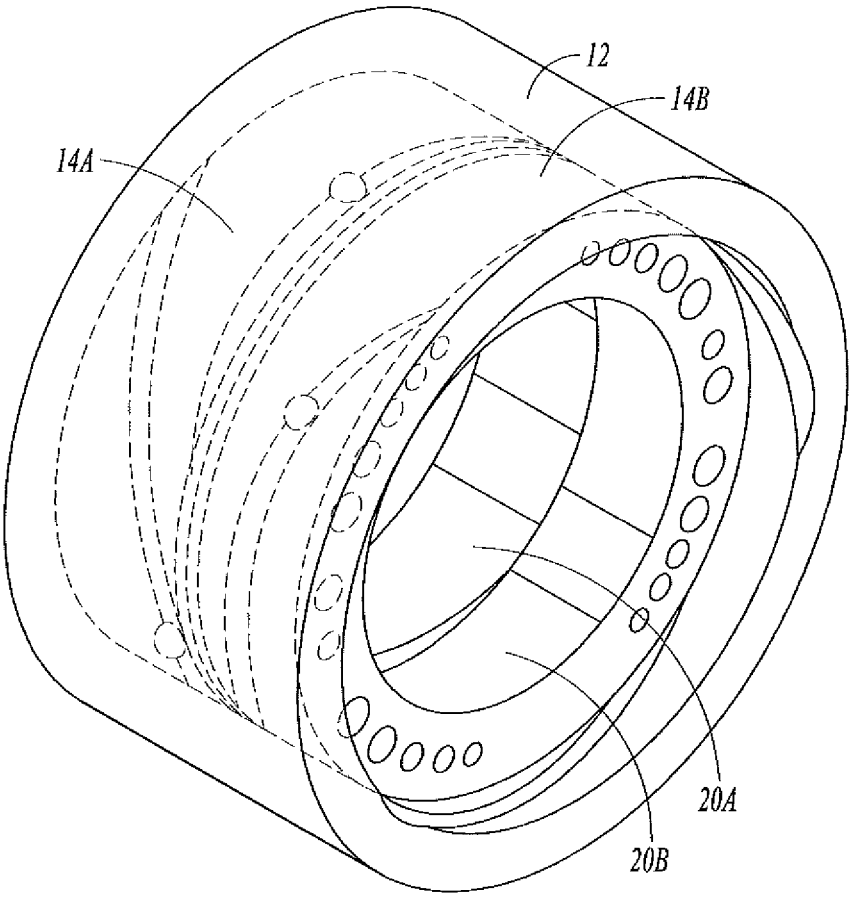
FIG. 3-3C are views of the adjuster and the rings of FIG. 1 with the rings disposed in a fully unregistered position according to an example of the present application.
Figure 3A:
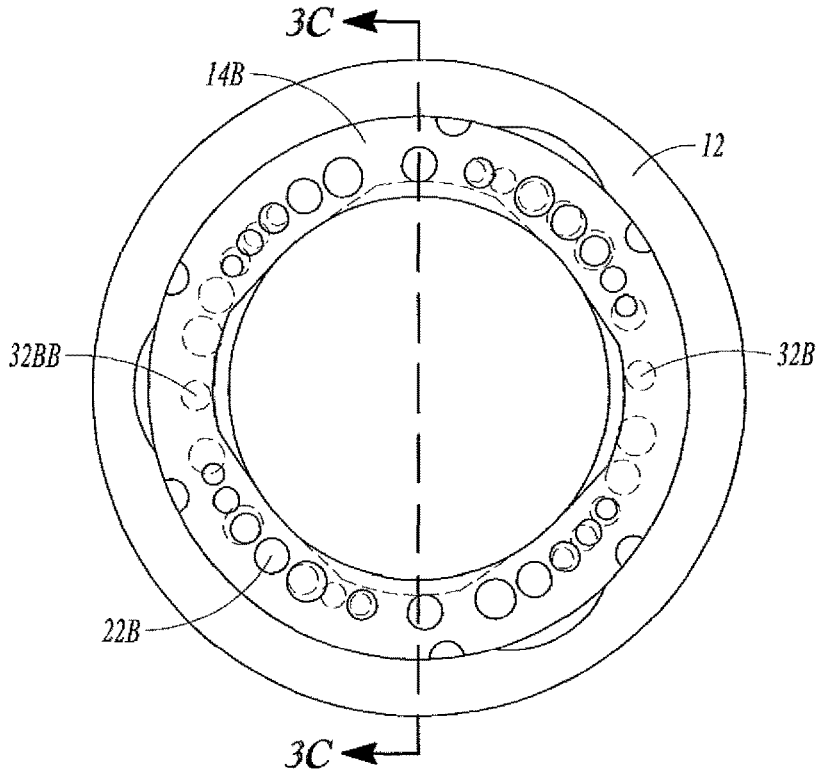
Figure 3B:
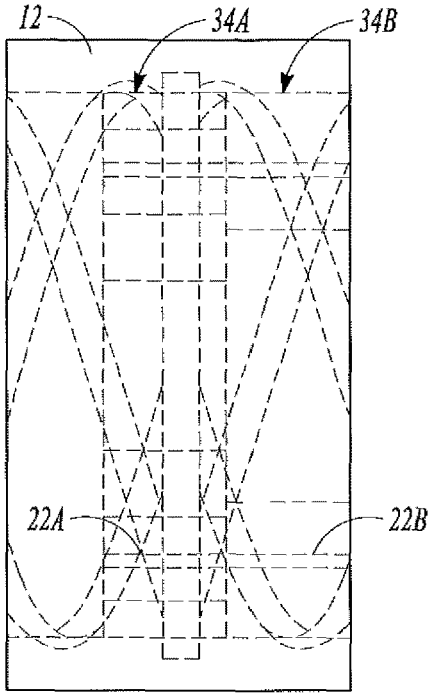
Figure 3C:
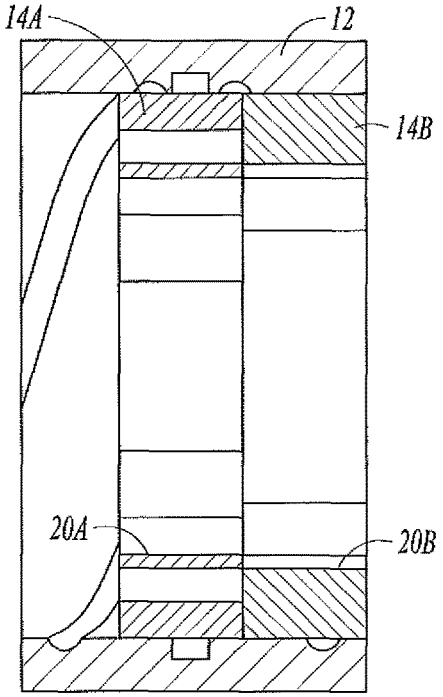

FIGS. 3-3C show the rings 14A and 14B disposed in the fully unregistered position with respect to each other within the adjuster 12. FIG. 3 shows flit rings 14A and 14B and adjuster 12 in a perspective view. FIG. 3A is an end view showing the ring 14B, adjuster 12, as well as passages 22B. FIG. 3B shows a side view of the adjustor 12 with the rings 14A and 14B shown in phantom. FIG. 3C is a cross-section of the adjuster 12 and rings 14A and 14B.

FIGS. 3A and 3B illustrate that according to some examples, some of the passages 22B and 22A of the rings may not align when the rings are in the fully unregistered position. In particular, some of the passages such as 32B, 32BB (FIG. 3A) are fully blocked, while others are only partially aligned for communication. As shown in the example of FIGS. 3-3C, in the fully unregistered position the inner surface 20B of the second ring 14B does not align with the inner surface 20A of the first ring 14A. FIG. 3B also illustrates a volume 34A between the outer surface 18A of the first ring 14A and a corresponding second volume 34B between the outer surface 18B of the second ring 14B can differ in size and shape. Such difference in volume and its effect on the displacement of the hydraulic machine will be discussed subsequently.

Figure 4:
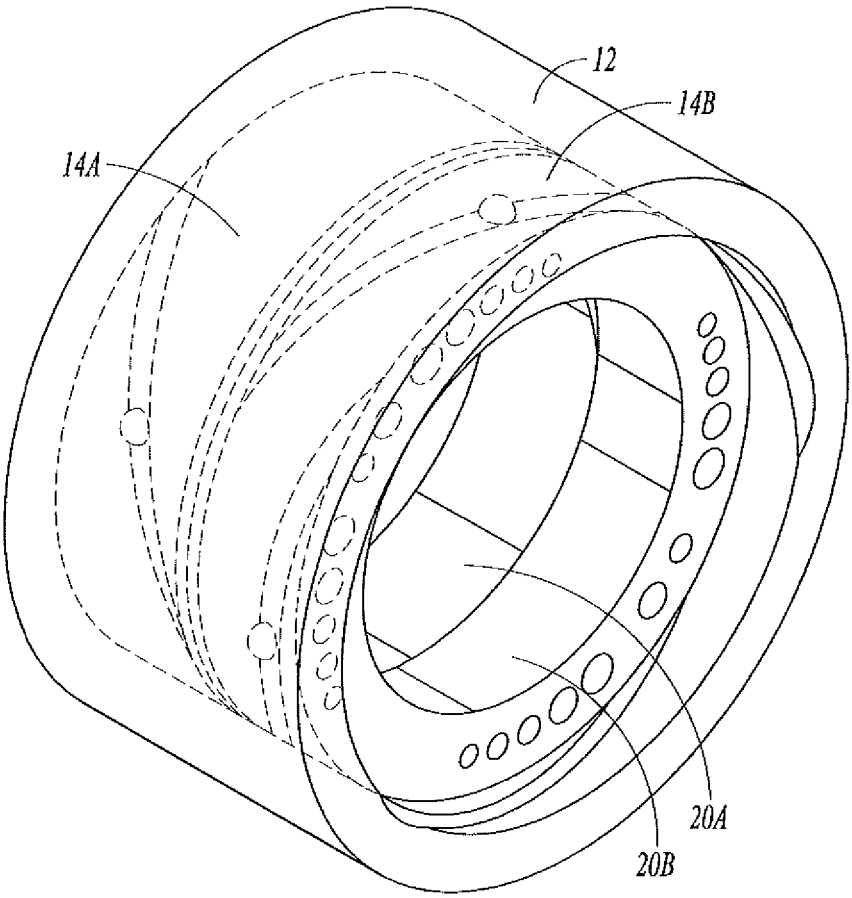
FIGS. 4-4C are views UI the adjuster and the rings of FIG. 1 with the rings disposed in a variable displacement position between the fully registered position of FIGS. 2A-2C and the fully unregistered position of FIGS. 3A-3C, according to an example embodiment of the present application.
Figure 4A:
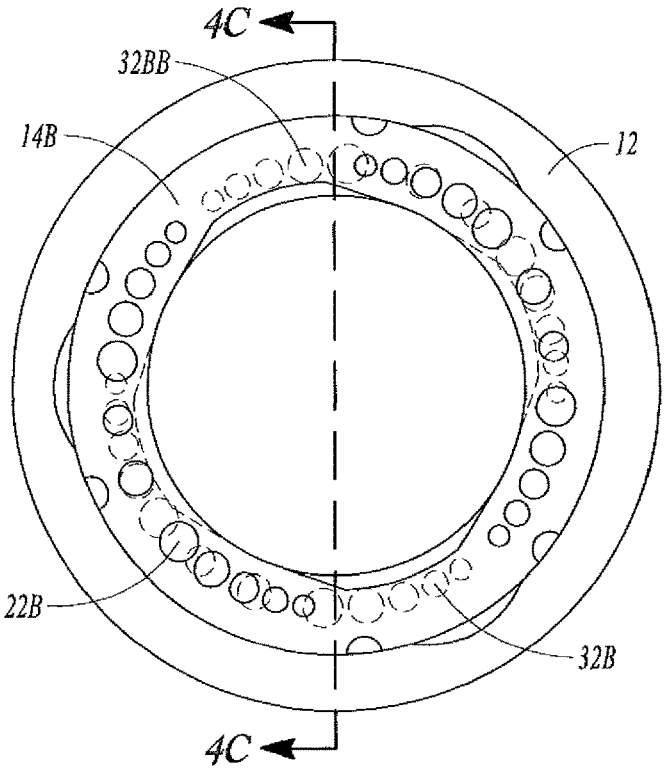
Figure 4B:
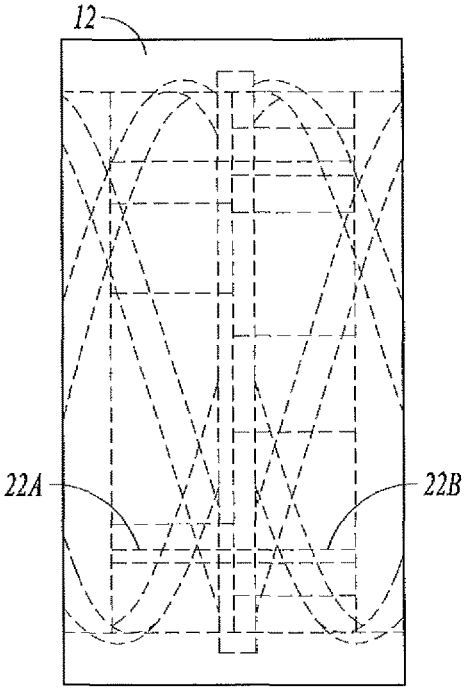
Figure 4C:
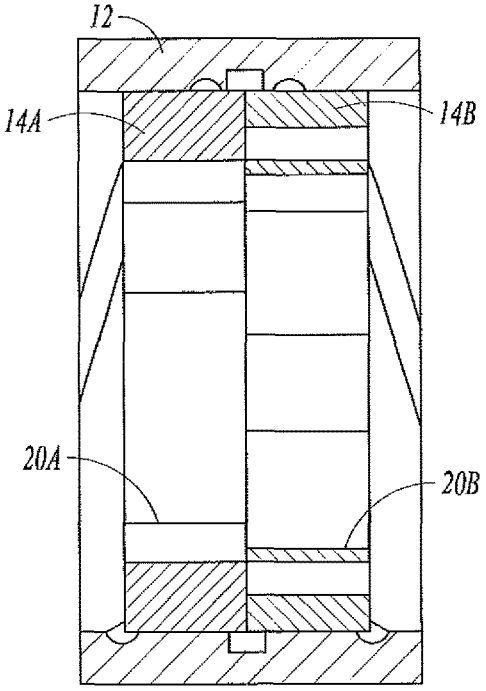

FIGS. 4-4C show the rings 14A and 14B disposed in one of the many positions that comprise a variable position between the fully registered position of FIGS. 2-2C and the fully unregistered position of FIGS. 3-3C. It should be noted that the variable position can comprise any one of plurality of different positions. The positioning of the rings 14A and 14B can be changed relative to one another in order to increase or decrease the displacement of the hydraulic fluid adjacent the rotor (not shown) and the rings 14A and 14B as desired.

FIG. 4 shows the rings 14A and 14B and the adjuster 12 in a perspective view. FIG. 4A is an end view showing the ring 14B, the adjuster 12, as well as the passages 22B. FIG. 4B shows a side view of the adjustor 12 with the rings 14A and 14B shown in phantom. FIG. 4C is a cross-section of the adjuster 12 and rings 14A and 14B.

FIGS. 4A and 4B illustrate that according to some examples, some of the passages 22B and 22A of the rings may not align when the rings are in the variable position. In particular, some of the passages such as 32B, 32BB (FIG. 4A) are fully blocked, while others are only partially aligned.

Figure 5A:
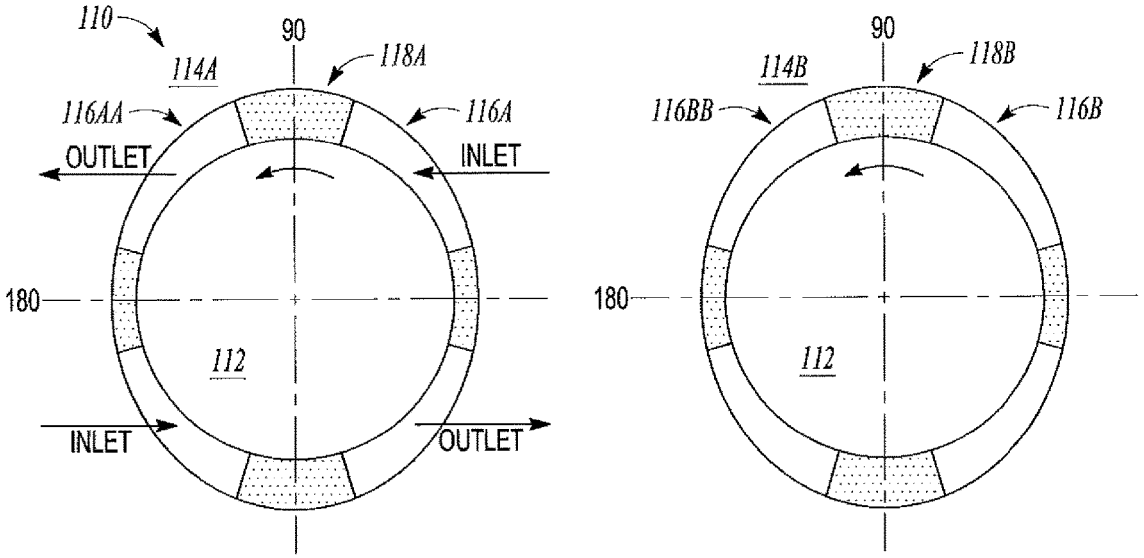
FIG. 5A is a schematic of the pair of rings cooperating with a rotor according to the fully registered position illustrated in FIGS. 2A-2C according to an example of the present application.

FIG. 5A illustrates a schematic of a portion of a hydraulic device 110 including a rotor 112, a first ring 114A and a second ring 114B. FIG. 5A shows the first ring 114A and the second ring 114B disposed in the fully registered position with respect to one another. Thus, the hydraulic device 110 is arranged for full displacement (or full drive if operable as a hydraulic coupling).

According to the example of FIG. 5A, when the rings 114A and 114B are aligned as illustrated, the pumping zones 116A, 116AA, 116B, and 116BB (sometimes called rise and fall regions or rise and fall zones) and sealing zones 118A and 118B (sometimes called dwell regions or dwell zones) have a similar shape (e.g., volume) and occur at substantially a same time. In the pumping regions 116A, 116AA, 116B, and 116BB (and illustrated in white), hydraulic fluid either enters the regions (as in regions 116A and/or 116B) through an inlet or is discharged through an outlet (as shown in regions 116AA and/or 116BB). According to some examples, only one ring (e.g., the first ring 114A) may have the inlet and the outlet. According to other examples, more than one ring or all the rings can have inlets and/or outlets. In yet other examples, one ring can have an outlet while a second ring can have an inlet. According to further examples, the rotor or another component can provide an inlet and/or an outlet to the pumping regions 116A, 116AA, 116B, 116BB as desired.

In operation, each ring 114A and 114B and rotor 112 combination operates as a variable vane hydraulic device. As such, the hydraulic device can be used to pump hydraulic fluids in many different types of machines for different purposes. The rotor 112 can typically have a generally cylindrical shape and the chamber defined by the rings 114A and 114B has a shape such that one or more rise and fall regions (pumping zones 116A, 116AA, 116B and 116BB) are formed between an outer wall of the rotor and an inner wall of the rings 114A and 114B. In the rise regions (e.g., pumping zones 116A and 116B), a larger space can open between the outer with wall of the rotor and the inner wall of the chamber. On the leading side of the rise region, there can exist a region which is substantially a dwell (e.g., sealing regions 118A, 118B), although in usual practice there can exist a small amount of fall. This is sometimes called a major dwell or major dwell region. The major dwell is followed by a fall region (e.g., pumping zones 116AA, 116BB), in which the space between the outer wall of the rotor and the inner wall of the chamber decreases. The rotor normally can have a number of slots and moveable vanes (not shown) can be mounted in the slots. As the rotor rotates, forces (centrifugal, hydraulic, and the like) can cause the vanes to move to an extended position as they pass through the rise regions. As the vanes travel along the fill regions, the vanes are forced to move toward a retracted position by virtue of the vanes contacting the inner wall of the chamber as they move into a region of restricted clearance between the rotor and chamber. Hydraulic fluid lubricates the vanes and the inner wall of the chamber. The action of the pump creates a flow in the fluid used in the hydraulic system. Further information on the construction and operation of variable vane hydraulic devices such a those used for hydraulic pumping are disclosed in for example, U.S. Patent Application Publication 2013/0067899A1 and U.S. Pat. Nos. 7,955,062, 8,597,002, and 8,708,679 owned by the Applicant and incorporated herein by reference.

Figure 5B:
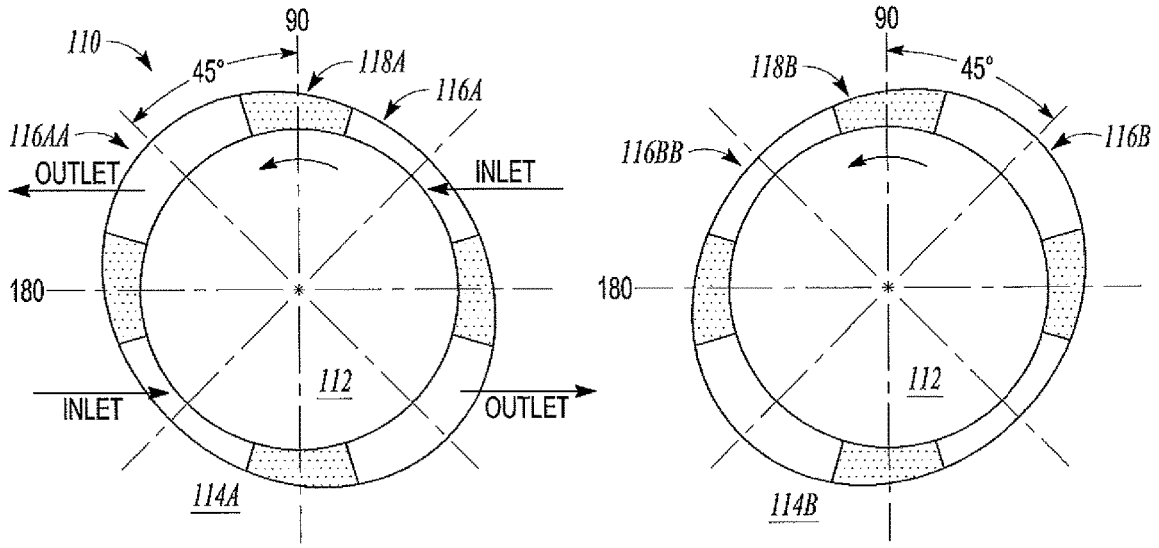
FIG. 5B is a schematic of the pair of rings cooperating with a rotor according to the fully unregistered position illustrated in FIGS. 3A-3C according to an example of the present application.

FIG. 5B illustrates the hydraulic device 110 of FIG. 5A having the rotor 112 but with the first ring 114A rotated relative to the second ring 114B to a fully unregistered position. Thus, the hydraulic device 110 is arranged for zero displacement (or zero drive if operable as a hydraulic coupling).

As show in the example of FIG. 5B, the first ring 114A is offset from the second ring 114B by substantially 90° (e.g., the first ring 114A is rotated to be offset by substantially 45° in a counterclockwise direction and the second ring 114B is rotated to be offset by substantially 45° in a clockwise direction from their positions in the fully registered position of FIG. 5A). As a result of this arrangement, the pumping zones 116A, 116AA, 116B, and 116BB and sealing zones 118A and 118B do not have a similar shape (e.g. volume) and do occur at substantially a same time. Indeed, in the fully unregistered position of FIG. 5B, the rings 114A and 114B have been rotated such that a rise region for the first ring/rotor corresponds to a fall region for the second ring/rotor, and vice versa. The result is that outward flow and intake flow of hydraulic fluid is balanced keeping the volume of fluid between successive pairs of vanes constant resulting in substantially zero displacement from the hydraulic device 110.

Figure 6A:
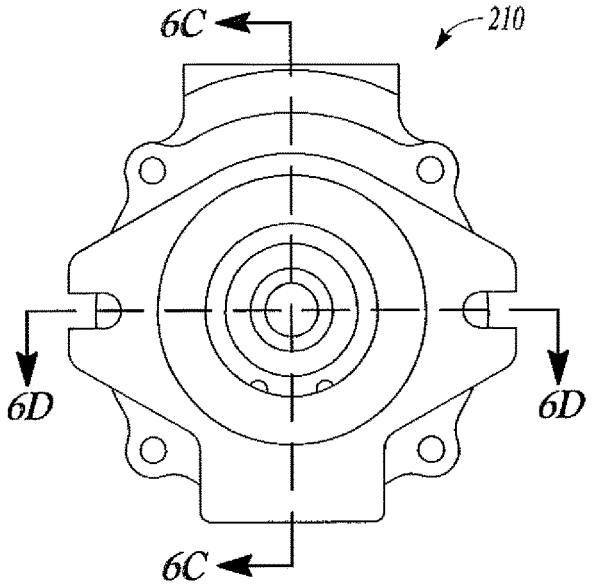
FIG. 6A is a front view of a hydraulic device according to an example of the present application.
Figure 6B:
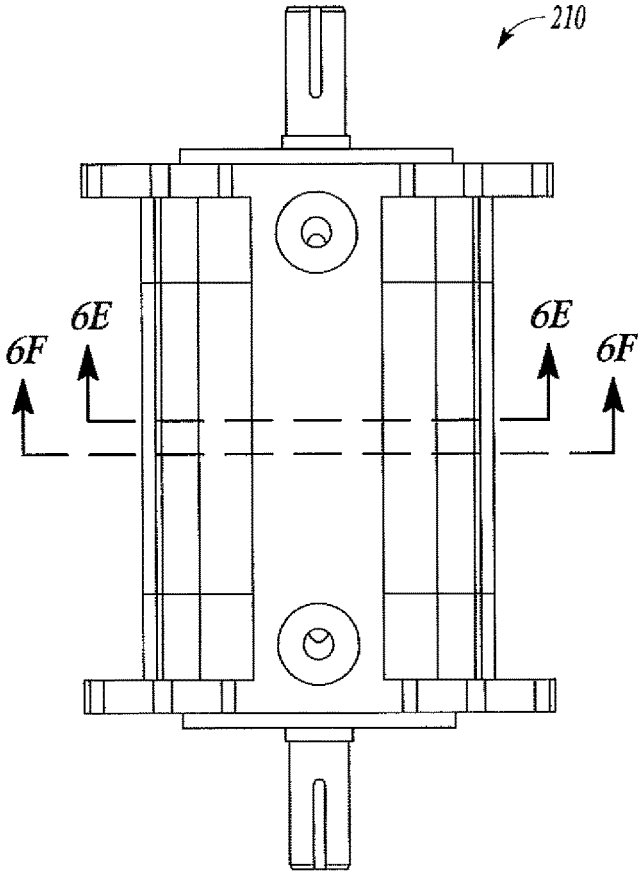
FIG. 6B is a side view of the hydraulic device of FIG. 6A.
Figure 6C:
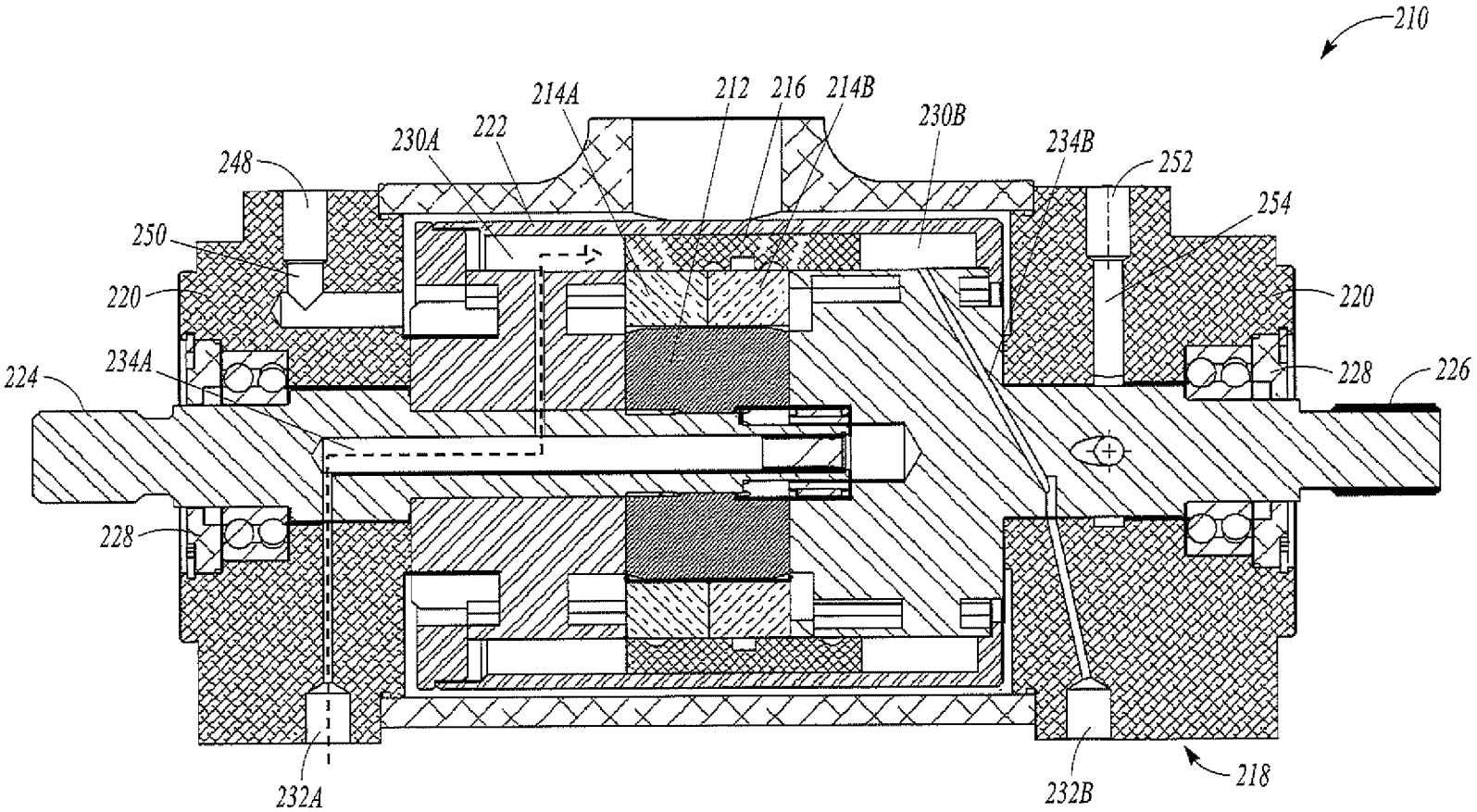
FIG. 6C is a cross sectional view of the hydraulic device of FIG. 6A taken along the line 6C-6C.
Figure 6D:
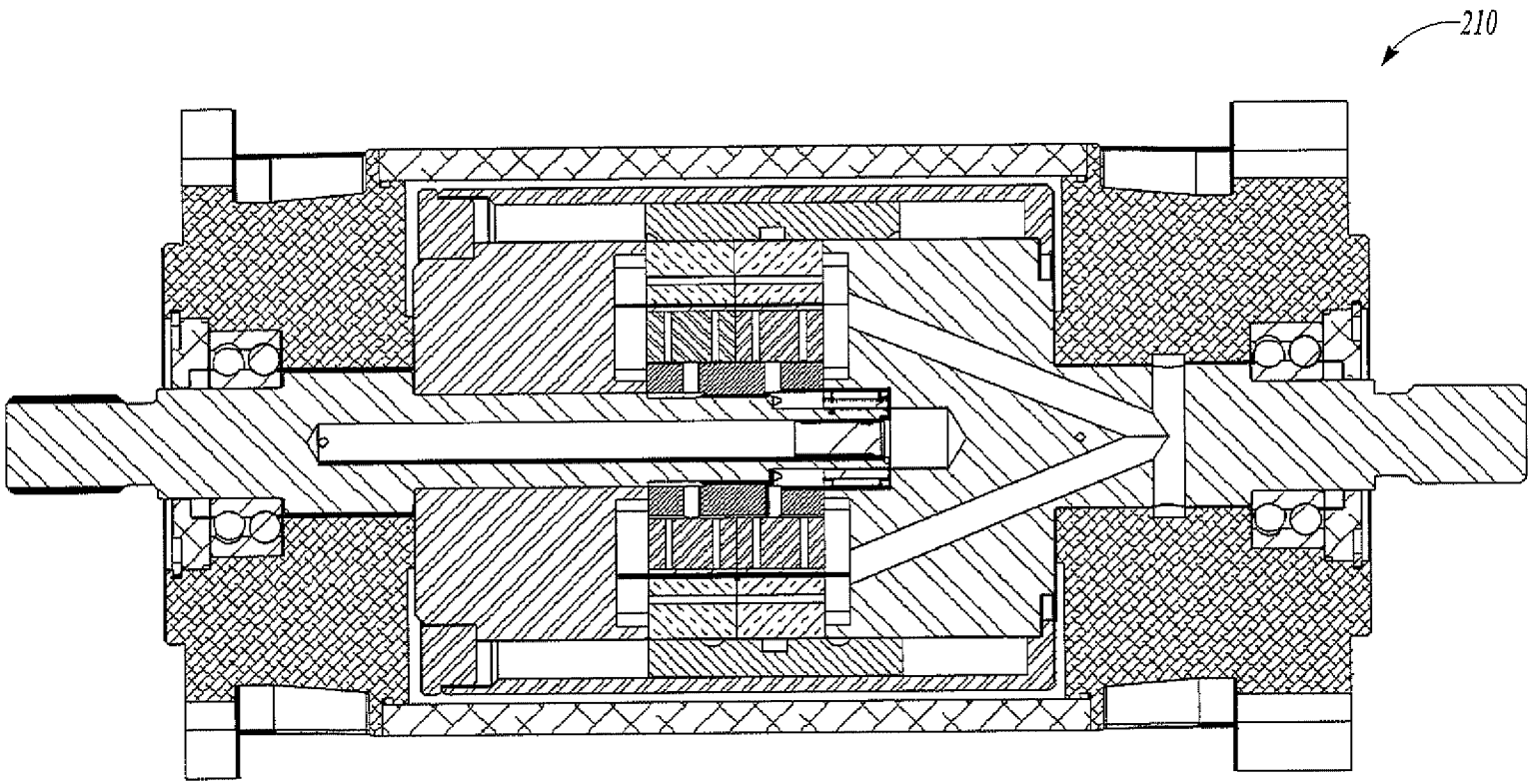
FIG. 6D is a cross sectional view of the hydraulic device of FIG. 6A taken along the line 6D-6D.
Figure 6E:
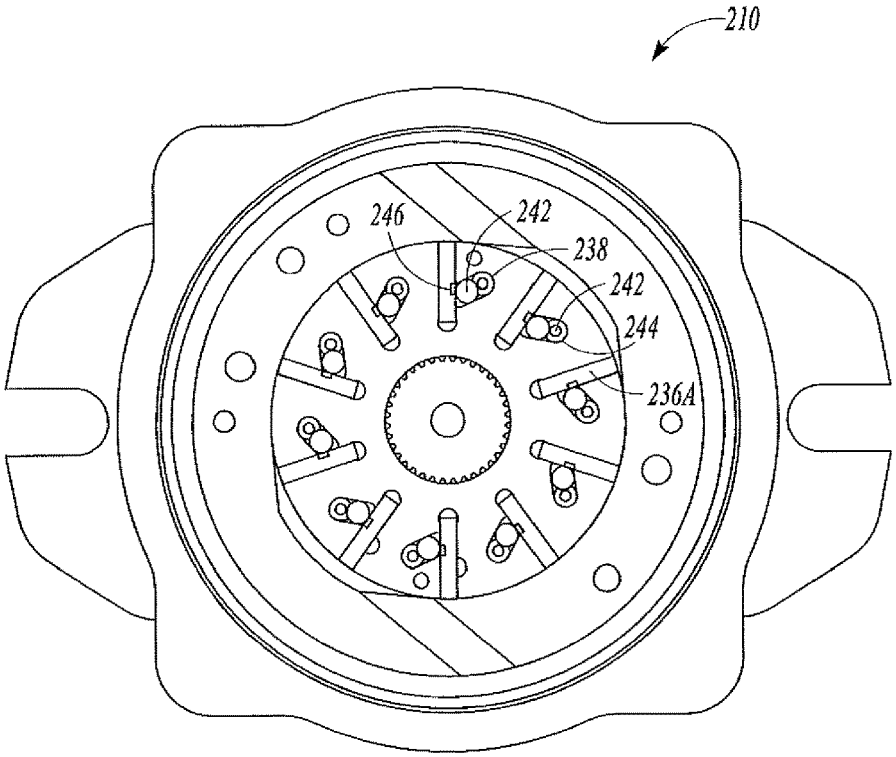
FIG. 6E is a cross sectional view of the hydraulic device of FIG. 6B taken along the 6E.
Figure 6F:
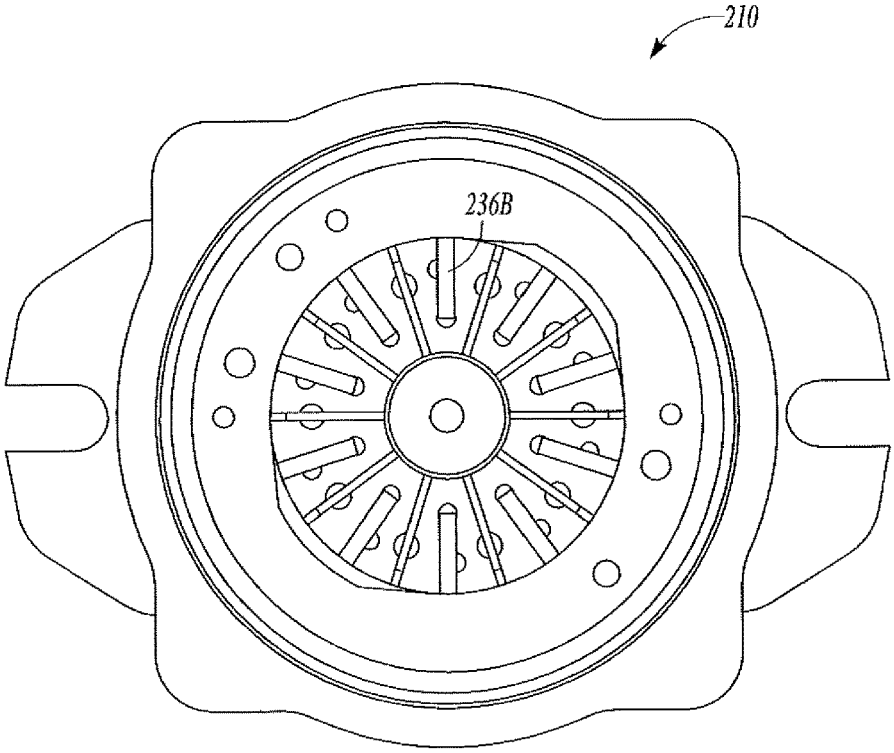
FIG. 6F is a cross sectional view of the hydraulic device of FIG. 6B taken along the line 6F-6F.

FIG. 6A is an end view of a hydraulic device 210 according to one example. FIG. 6B is a side view of the hydraulic device of FIG. 6A. FIG. 6C is a cross section of the hydraulic device 210 taken along the line 6C-6C of FIG. 6A. FIG. 6D is a cross section of the hydraulic device 210 taken along the line 6D-6D of FIG. 6A. FIG. 6E is a cross section of the hydraulic device 210 taken along the line 6E-6E of FIG. 6B. FIG. 6F is a cross sectional view of the hydraulic device of FIG. 6B taken along the line 6F-6F. The hydraulic device 210 is configured as both a hydraulic pump and as a hydraulic coupling. As shown in FIG. 6C, the hydraulic device 210 can include a rotor 212, a first ring 214A, a second ring 214B, an adjustor 216, a housing 218, end bodies 220, an inner cosine 222, an input shaft 224, an output shaft 226, and rotary seals 228.

The operation of the rotor 212, the rings 214A and 214B, and the adjustor 216 has been discussed previously, and therefore, will not be discussed in great detail. The rings 214A and 214B, and the adjustor 216 can be similar to those described in reference to FIGS. 1-4C or FIG. 9, for example. According to the example of FIGS. 6A to 6E, the housing 218 can generally enclose the rotor 212, rings 214A and 214B, the adjustor 216 and other components. The housing 218 can include the two end bodies 220 according to some examples. The inner casing 222 can surround the adjustor 216 forming pressure chambers 230A and 230B to either axial end thereof. Pressure in the pressure chambers can be controlled through pressure regulators or other known methods to control linear movement of the adjustor 216, and hence, rotational orientation of the rings 214A and 214B.

The input shaft 224 extends within the housing 218 through one of the end bodies 220 and is coupled to the rotor 212. The output shaft 226 extends within the housing 218 through the other of the end bodies 220 and is disposed adjacent to and interfaces with the input shaft 224 and the rotor 212. In some examples, hydraulic fluid is directed to flow to a separate reservoir (not shown). Alternatively, some examples can use a tarp housing that accommodates enough fluid for operation and cooling. The hydraulic device 210 is not limited to application in which the housing 218 is used to retain fluid.

Sealed examples such as the example of FIG. 6C can have the rotary seals 228 disposed between the end bodies 220 and the input shaft 224 and the output shall 226 to retain the hydraulic fluid. In various examples, ports 232A and 232B and passages 234A and 234B allow hydraulic fluid (oil, water/glycol, or the like) into and out of the housing 218 and direct hydraulic fluid to-and-from the pressure chambers 230A and 230B. In some examples, the ports 232A and 232B and passages 234A and 234B are also configured to direct hydraulic thud to extend and retract the vanes 236A (FIG. 6E), 236B (FIG. 6F) to engage and disengage the hydraulic coupling or to implement or cease pumping operation. A pair of the vanes 236A and 236B are utilized in each slot of the rotor 212 due to the separation between the rings 214A and 214B. Ports 232A and/or 232B in some examples provide remote control of a safety pressure relief valve. Control of pressure in the hydraulic device 210 can be effected by, for example, controlling a balanced piston as described in US Patent Application Publication No. 2013/00067899.

As shown in the example of FIGS. 6E and 6F, the vanes 236A, 236B can be controlled to be either restrained or released, such as by moving retainers, including wide portions 238 (FIG. 6E) and narrow portions 240 (FIG. 6E), to move a hall 242 (FIG. 6E) through a passage 244 (FIG. 6E) at least partially into a detent 246 (FIG. 6E) to retain the vane 236A. One example of vane retraction or release is set forth in US Patent Application Publication No. 2006/0133946 commonly assigned and incorporated herein by reference. Release of the vanes will result in the operation of the hydraulic device that will try to operate as a hydraulic pump.

According to some examples, the varies 236A, 236B are aided in movement (extension and retraction) by a fluid pressure assist signal. The fluid pressure assist can supply all of the force needed to extend the vanes 236A, 236B, or a portion of the force, with a remainder supplied by an inertial force experienced during high speed rotation of the rotor 212. In other examples, an inlet signal can be used to control the extraction or retraction of a retainer to lock one or more vanes 236A, 236B in a retracted position, or to unlock the retainers so that they can extend. Some examples can include a valve (not shown) to control pressurization of one or more assist signals.

Various examples can also include an optional remote pressure control. In some examples, the remote pressure control can be coupled to one side of a balance piston, with pump output in fluid communication with the opposite side of the balance piston. The balance piston can be used to control whether the device can pump. For example, if the remote pressure control is set to a pressure, the balance piston allows coupling discharge pressure to rise until the coupling discharge pressure is higher than the pressure, moving the balance piston to overcome the remote pressure control pressure. As the balance piston moves, it enables the coupling discharge to drain, such as to tank. In such a manner, the maximum torque transmitted is remotely controllable via the remote pressure control signal. In some examples, the remote pressure control is used in addition to a primary relief valve that allows oil to pump in any case where a torque differential between a couple input and a couple output exceeds a predetermined threshold.

In some examples such as that of FIG. 6C, a port 248 and passage 250 is configured to communicate hydraulic fluid to adjacent (e.g., between) the rotor 212 and the rings 214A and 214B and similarly a discharge port 252 and a passage 254 are configured to communicate the worked hydraulic fluid away from the rotor 212 and the rings 214A and 214B.

As discussed, the input shaft 224 can be connected to the rotor 212. In some examples, the input shaft 224 rotates inside hearings and/or a bushing. The input shaft 224 is configured for connection to a power source such as a gas motor, an electric motor or diesel engine or the like in some embodiments. The output shaft 226 rotates inside bearings. Bearing applications can optionally be substituted with bushings, and vice versa.

Output shaft 226 can be connected to the inner casing 222, in some embodiments. The adjuster 216 can be connected to the inner casing 222, for example, by spline or key or similar method that allows for translational movement of the adjuster 216. Further details regarding arrangement, construction, and operation of the input shaft 224 and output shaft 226 can be found in US Patent Application Publication No. 2013/00067899, commonly assigned and incorporated herein by reference.

In one mode of operation, the hydraulic device 210 releases the vanes 236A and 236B on the spinning shaft resulting in the vanes 236A and 236B working to pump the fluid. However, fluid escape from a pump chamber is resisted, such as by forcing the fluid against a relief valve calibrated to a predetermined pressure such as a high pressure. It should be noted that since little pumping occurs, part wear is less of a concern than in a vane pump. In various examples, the input shaft 224 converts energy into a hydraulic force that is resisted by the forces on output shaft 226. This hydraulic force is generated from the fluid trapped by the vanes 236A (illustrated in FIG. 6E), 236B (FIG. 6F) working the fluid against the rotor 212 contained by the rings 214A and 214B causing output shaft 226 to rotate when hydraulic device 210 is operable as a hydraulic coupling. Output shaft 226 can be locked using known mechanical (e.g., clutch) or hydraulic (e.g., relief valve set to a relatively low pressure) methods such that hydraulic device 210 is operable as a vane pump with worked fluid being displaced through the passage 254 and out the discharge port 252.

Figure 7A:
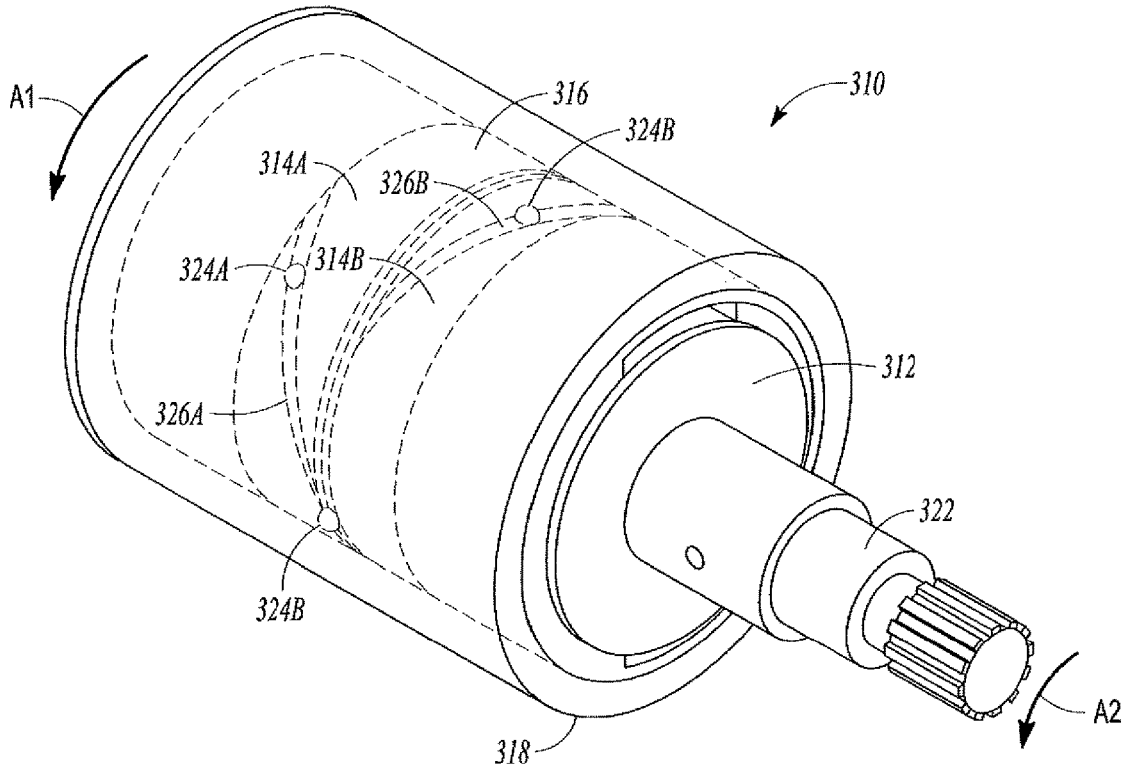
FIG. 7A is a perspective view of portions a hydraulic device including the output shaft, the adjuster, and die rings according to an example of the present application.
Figure 7B:
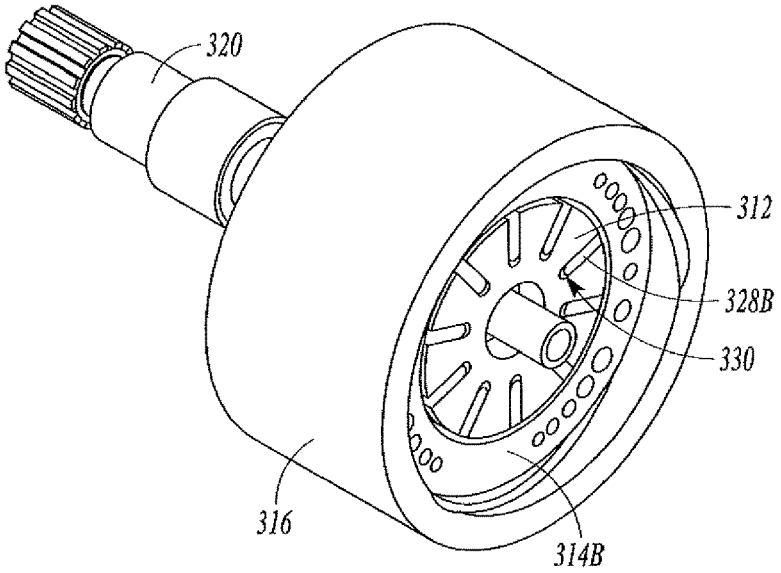
FIG. 7B is a perspective view of portions the hydraulic device of FIG. 7A including the adjuster, one of the rings, an input shaft, a rotor and a plurality of vanes according to an example of the present application.
Figure 7C:
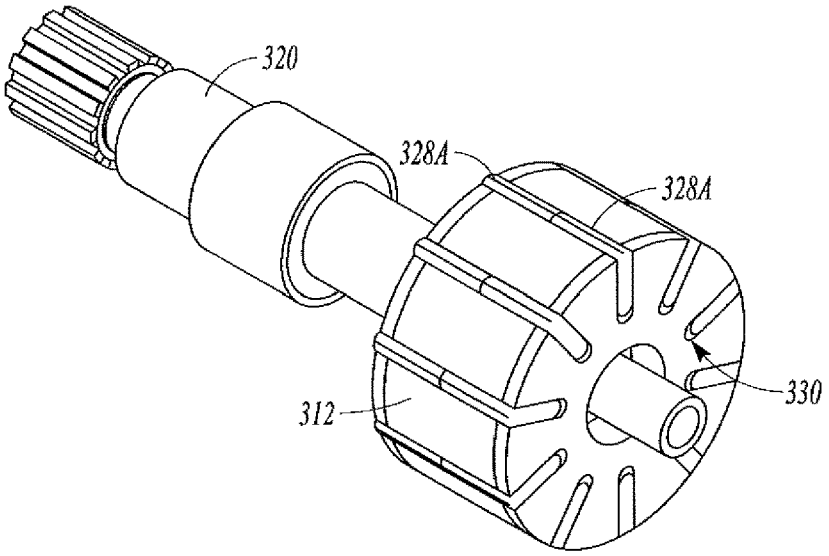
FIG. 7C is a perspective view of portions the hydraulic device of FIG. 7A including the input shaft, the rotor, and the plurality of vanes of FIG. 7B.

FIGS. 7A-7C illustrate a hydraulic device 310 similar to those described in reference to FIGS. 1-4C and 6A-6E. Indeed, the hydraulic device 310 can be similar in construction and operation to hydraulic device 10 described in FIGS. 1-4C. The hydraulic device 310 can include a rotor 312 (FIGS. 7B and 7C), a first ring 314A, a second ring 314B, an adjuster 316, a casing 318, an input shaft 320 (FIGS. 7B and 7C), and an output shaft 322 (FIG. 7A).

FIG. 7A shows operation of the hydraulic device 310 as a hydraulic coupling with the illustrated components including the rotor 312, the first ring 314A, the second ring 314B, the adjuster 316, the casing 318, the input shaft 320, and the output shaft 322 coupled so as to rotate together as indicated by arrows A1 and A2.

FIG. 7A shows the adjuster 316 and the casing 318 in phantom so as to illustrate the first ring 314A and the second ring 314B. The example of FIG. 7A also illustrates that the hydraulic device 310 can utilize a first bearing 324A, a second bearing 324B (two shown in FIG. 7A), and opposing helical guides 326A and 326B in the manner described with respect to FIGS. 1-4C in order to effectuate relative rotation of the first ring 314A and the second ring 314B with movement of the adjuster 316.

FIG. 7B shows the adjuster 316 disposed about the second ring 314B (the first ring 314A is not shown). The rotor 312 is disposed within the second ring 314B and vanes 328B are actuated to extend from the slots 330 in the rotor 312 toward the inner surface of the second ring 314B. FIG. 7C shows the rotor 312 coupled to the input shaft 320 and the vanes 328A and 328B, comprising two vane pairs, one corresponding to each ring 314A and 314B received in the slots 324 in the rotor 312.

Figure 8:
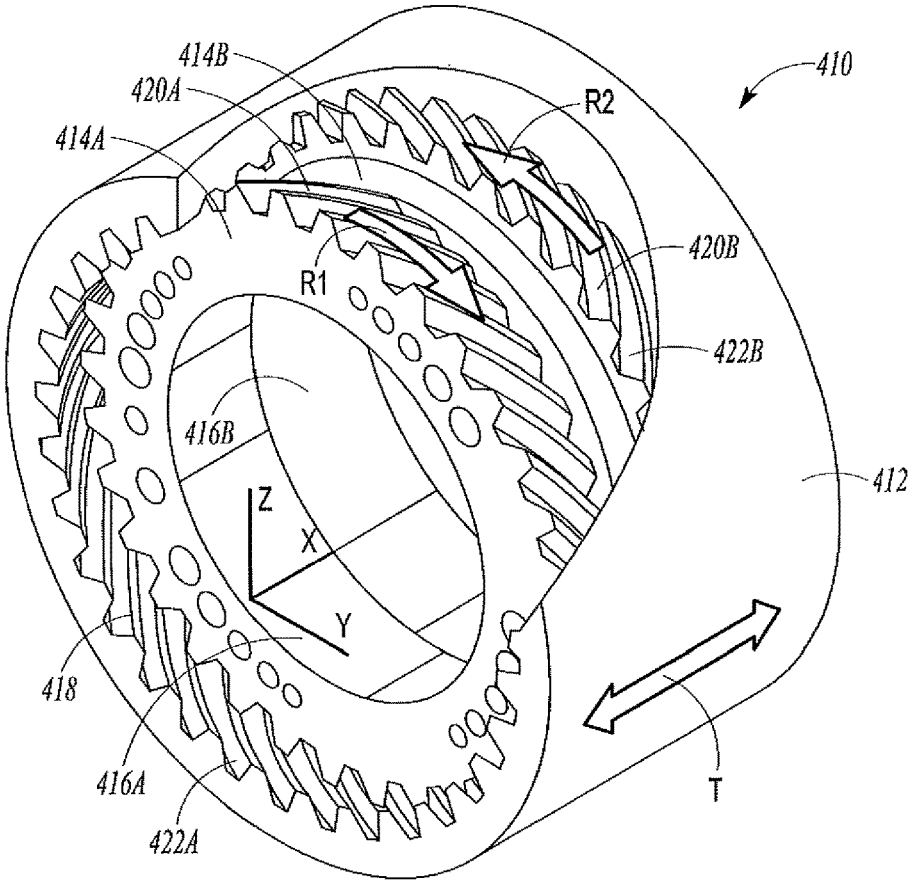
FIG. 8 is a perspective view a portion of a hydraulic device comprising a pair of rings and an adjuster according to an example of the present application.

FIG. 8 shows another example of a portion of a hydraulic device 410. The hydraulic device 410 is similar in construction and operation to the hydraulic device 10 of FIGS. 1-4C. Thus, the hydraulic device 410 includes an adjuster 412 and rings 414A and 414B. The rotor is not illustrated in FIG. 8 in order to show the inner surfaces 416A and 416B of the first ring 414A and 414B, respectively. The inner surfaces 416A and 416B are configured in the manner discussed with reference to FIGS. 1-4C. Additionally, the adjuster 412 includes an inner surface 418. The inner surface 418 has a first helical spline 420A and a second helical spline 420B. The first ring 414A has an outer surface that has a spline 422A. The second ring 414B has an outer surface that has a helical spline 422B. Although described with reference to splines other mechanical methods such as threads can be used as desired to couple the rings 414A, 414B to the adjuster 416 in a manner that allows for relative rotational adjustment.

A first portion of the inner surface 418 has the first helical spline 420A and a second portion of the inner surface 418 has the second helical spline 420B. The second Helical spline 420B extends in an opposing helical direction to the first helical spline 420A. Helical spline 422A of the first ring 414A is configured to correspond to and mate with the first helical spline 420A. Similarly, the helical spline 422B if the second ring 414B is configured to correspond to and mate with the second helical spline 420B. In this manner, when the adjuster 412 is moved (e.g. linearly translated) relative to the rings 414A, 414B as indicated by arrow T, the rings 414A and 414B rotate in opposing directions as indicted by arrows R1 and R2.

Figure 9:
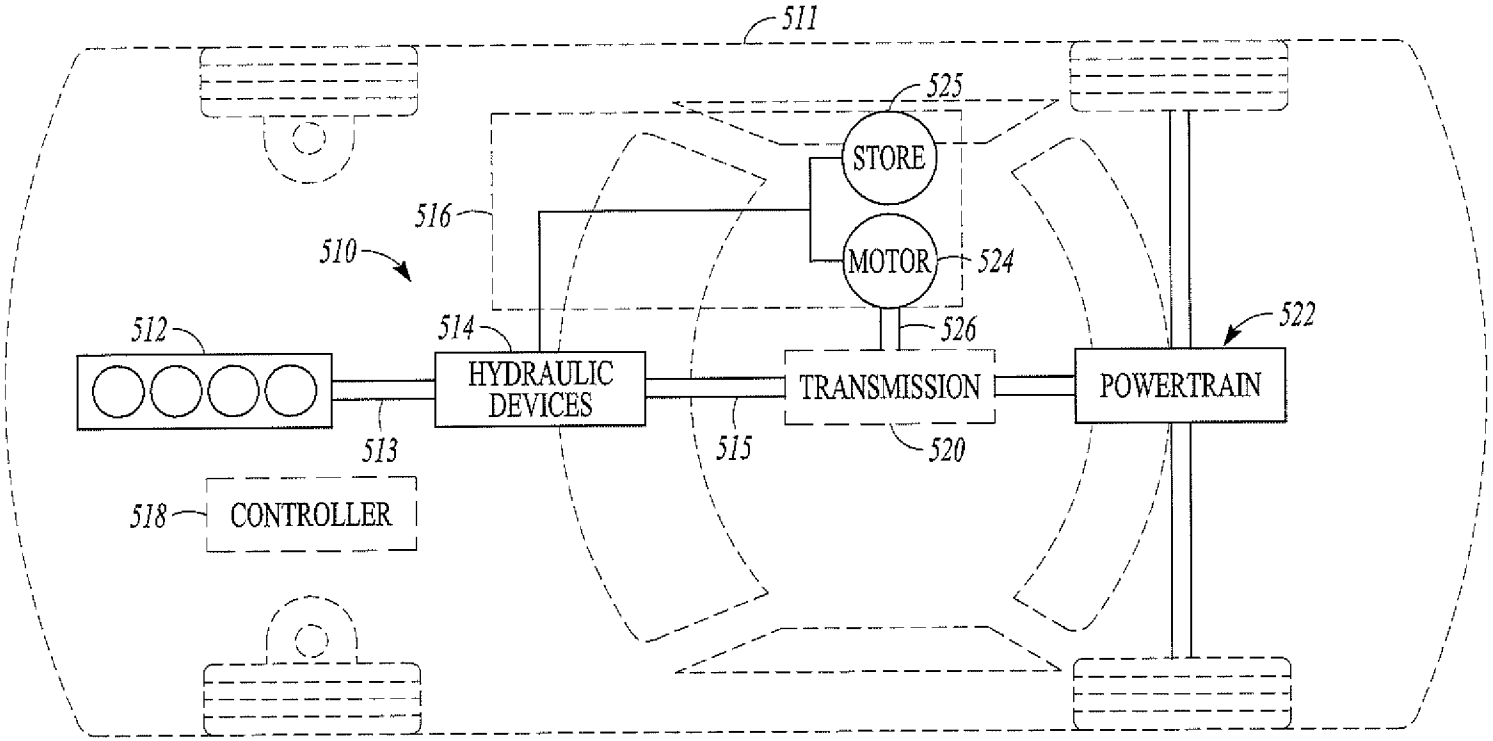
FIG. 9 is a schematic view of a vehicle including a vehicle system having a hydraulic device, a pump/motor, a storage apparatus, a prove train, and accessory hydraulic systems, according to an example of the present application.

FIG. 9 shows a highly schematic view of a system 510 aboard a vehicle 511. As will be discussed subsequently, the system 510 can include a torque source 512, an input shall 513, a hydraulic device 514, an output shaft 515, a plurality of accessories 516, a controller 518, a transmission 520, and a power train 522. The plurality of accessories 516 can include a pump motor 524, a storage device 525, and one or more output shafts 526.

The hydraulic device 514 can be used to pump hydraulic fluid to the plurality of accessories 516 including the pump motor 524, the storage device 524 (e.g. an accumulator), and/or one or more auxiliary systems (e.g., power steering, bucket hydraulic system, etc.).

It should be noted that the hydraulic devices described herein provide for variable flow as well as variable drive capability in addition to providing for a drive only, pump only, and non-pump/non-drive capability. Such capabilities along with the plurality of accessories 516 and other system 510 components allow far various system operation modes. Each system operation mode allows the vehicle to perform various tasks as desired with little unnecessarily wasted hydraulic energy. For example, variable flow capability allows a desired amount of flow to be directed as needed, excessive flow is avoided. As disclose the hydraulic device 510 and the plurality of accessories 516 can be controlled in or more system operation modes including in one or more of a tandem torque amplifying wheel drive mode, a tandem steady state wheel drive mode, a tandem vane pumping mode, a regenerative energy storage mode, a regenerative energy application mode, and a tandem wheel drive and vane pumping mode. A further explanation and detail of these modes and the modes benefits can be found in U.S. Patent Application Ser. No. 62/104,975, the disclosure of which is incorporated by reference.

The illustration of FIG. 9 represents one possible configuration (e.g., with the hydraulic device 514 disposed before the transmission 520 and with output shaft 515 (including shaft 526) coupled to the transmission 520), with other configurations possible. The torque source 512 can comprise any source including, but not limited to, an engine, a flywheel, an electric motor, etc. The torque source 512 is coupled to the input shaft 513 for the hydraulic device 514. The torque source 512 outputs torque/power to the hydraulic device 514, which can selectively transmit the torque/power via the output shaft 515 to the transmission 520 or another power train 522 system. Although not illustrated in FIG. 9, the hydraulic devices 514 can be intelligently controlled by pilot signal(s), valve(s), etc. to selectively transmit power/torque or utilize the power/torque for pumping a hydraulic fluid m the plurality of vehicle accessories 516. The controller 518 (e.g. vehicle ECU) can be configured to communicate with various systems and components of the system 510 and vehicle and can be operable to control the system operation mode (discussed previously) based on a plurality of vehicle operation parameters (e.g., deceleration, acceleration, vehicle speed, desire or need to operate various auxiliary systems including hydraulically powered systems, etc.).

As has been discussed previously, the hydraulic device 514 can each be configured to be operable as a hydraulic coupling and as a vane pump and can be controlled to operate in a manner that provides for coupling only, coupling and vane pumping, variable pumping only, etc. Accordingly, the hydraulic device 514 is coupled to the input shaft 513 and the output shaft 515. Additionally, FIG. 9 illustrates an example where the hydraulic device 514 is in fluid communication with the plurality of accessories 516. FIG. 9 illustrates one of the accessories 516, the pump motor 524, which is coupled to the transmission 520 by the output shaft 526. According to additional examples, the plurality of accessories 516 can comprise, for example, the storage device 526, and/or one or more auxiliary systems (e.g., systems for cooling fan drives, dump boxes, power steering, compressor systems, alternator systems, braking systems, fire suppression systems, hydraulic equipment related systems, etc.).

According to the example of in FIG. 9, the hydraulic devices 514 can operate as a hydraulic pump, and thus, operates as part of a hydraulic system for the vehicle. Various intelligent controls (electronic, pressure compensated, lever, and/or digital) of valves, bleed valves, components, etc. can be utilized to control the direction and amount of hydraulic fluid to and from the plurality of accessories 516 and the hydraulic device 514. The present systems benefit from precise control. For example, programmable torque settings affected by adjustment of the pressure relief setting result in predetermined stall points. Such programmable stall points can be either fixed or remotely set by associating relief valve setting with a remote conventional override relief valve. A further benefit of precise control can be controlled acceleration or deceleration by varying relief valve settings to match desired maximum torques. In such embodiments, start and stop torques can be reduced to limit high peak torque levels that can damage machinery.

In one example, fluid communicating interior portions of at least one of the plurality of hydraulic devices and/or the plurality of accessories can be coated in a diamond or diamond-like carbon. According to further examples, the fluid communicating interior portion includes a roller bearing of each of the plurality of hydraulic devices and/or and an inner face of a gear ring of the transmission. According to further examples, the one or more fluid communicating portions the rotor and the two or more rings can be coated in a diamond or diamond-like carbon. The diamond or diamond-like carbon coating can comprise a coating as disclosed in U.S. Pat. No. 8,691,063B2, the entire specification of which is incorporated herein by reference. The use of a diamond or diamond-like coating can reduce or prevent corrosion of the steel housing and other steel components that arc in fluid communication with the hydraulic fluid. Thus, the diamond or diamond-like carbon coating can allow for the use of environmentally friendly hydraulic fluids such as glycol that may otherwise have been too corrosive.

The disclosed hydraulic devices with the disclosed systems can allow for: 1) greater variability of range of torque transfer, acceleration, deceleration, and 2) greater versatility of hydraulic fluid pumping to the plurality of accessories. Other benefits of the system can include reducing peal transient forces experienced by the transmission 520, reduced hydraulic noise, greater fuel efficiency, reduced emissions, among other benefits.

Other examples net specifically discussed herein with reference to the FIGURES can be utilized. The disclosed vehicle systems are applicable to various types of vehicles such as earth moving equipment (e.g., wheel loaders, mini-loaders, backhoes, dump trucks, crane trucks, transit mixers, etc.), waste recovery vehicles, marine vehicles, industrial equipment agricultural equipment) personal vehicles, public transportation vehicles, ad commercial road vehicles (e.g., heavy road trucks, semi-trucks, etc.).

Although specific configurations of devices and accompanying systems are shown in FIGS. 1-9 and particularly described above, other designs that fall within the scope of the claims are anticipated.

Example 1 is a hydraulic device comprising: two or more rings rotatably mounted within the hydraulic device and arranged adjacent one another configured for relative rotation with respect to one another; a rotor disposed for rotation about an axis within the two or more rings, the rotor having a plurality of circumferentially spaced slots configured to house a plurality of vanes therein, the plurality of vanes configured to be movable between a retract position and an extended position where the plurality of vanes work a hydraulic fluid introduced adjacent the rotor; and an adjuster configured to translate linearly to rotatably position the two or more rings relative to one another to increase or decrease a displacement of the hydraulic fluid adjacent the rotor and the two or more rings.

In Example 2, the subject matter of Example 1 optionally includes wherein the two or more rings are selectively rotatable relative to one another between a fully registered position where the inner surfaces of the two or more rings are in-phase with one another so that the inner surfaces substantially align and a fully unregistered position where the inner snakes of the two or more rings are out-of-phase with one another.

In Example 3, the subject matter of Example 2 optionally includes wherein positions of the two or more rings are variable with respect to one another between the fully registered position and the fully unregistered position.

Example 4, the subject matter of any one or more of Examples 1-3 optionally include the adjuster comprises a sleeve configured to receive the two or more rings therein, the sleeve having an inner surface with one or more grooves therein, and further comprising: a first hearing coupled to one of the two or more rings at an outer surface; thereof and received in one of the one or more grooves.

In Example 5, the Subject matter of Example 4 optionally includes wherein the one or more grooves comprise two spaced apart grooves including the one of the two grooves helically extending in a first direction and is second of the two grooves helically extending an opposing helical direction.

In Example 6, the subject matter of Example 5 optionally includes a second bearing coupled to a second of the two or more rings at an outer surface thereof and wherein the first bearing is received in the one of the two grooves and the second bearing is received in the second of the two grooves.

In Example 7, the subject matter of Example 6 optionally includes wherein the first of the two or more rings is rotatable in a first direction and the second of the two or more rings is rotatable in a second direction opposite the first direction.

In Example 8, the subject matter of any one or more of Examples 1-7 optionally include further comprising: an input shaft coupled to rotate the rotor; an output shaft; and hydraulic fluid communication passages including an input passage configured to introduce the hydraulic fluid adjacent the rotor and an output passage configured to transport the hydraulic fluid away from the rotor; wherein the hydraulic device is operable as both a vane pump to pump the hydraulic fluid and a hydraulic coupling to couple the input shaft with the output shaft.

In Example 9, the subject matter of Example 8 optionally includes wherein the hydraulic device is simultaneously operable as the vane pump and the hydraulic coupling with the plurality of vanes in die extended position and the two or more rings in an intermediate position between a fully registered position where the inner surfaces of the two or more rings are in-phase with one another and to fully unregistered position where the inner surfaces of the two or more rings are out-of-phase with one another.

In Example 10, the subject matter of any one or more of Examples 1-9 optionally include wherein one or more fluid communicating portions the rotor and the two or more rings are coated in a diamond or diamond-like carbon.

In Example 11, subject matter of any one or more of Examples 1-10 optionally include wherein the adjuster includes an inner surface that is splined and is configured to mate with a corresponding splined outer surface of the two or more rings.

In Example 12, the subject matter of Example 11 optionally includes wherein the inner surface includes a first portion that has a helically spline with the helical spline extending in a first helical direction and includes a second portion that has a helical spline with the helical spline extending in a second helical direction generally opposed to the first helical direction, and wherein a first ring of the two or more rings has a helically splined outer surface corresponding to the helical spline of the first portion and a second ring of the two or more rings has a helically splined outer surface corresponding to the helical spline of the second portion.

Example 13 is a vehicle system comprising; a hydraulic device comprising: a pair of rings rotatably mounted within the hydraulic device, the rings having non-circular shaped inner surfaces and configured for relative rotation with respect to one another, a rotor disposed for rotation about an axis within the two or More rings and coupled to the input shaft, the rotor having a plurality of circumferentially spaced slots, a plurality of vanes located such that each slot has a vane located therein, the plurality of vanes configured to be movable between a retracted position and an extended position, and an adjuster configured to rotatably position the rings relative to one another to increase or decrease a displacement of a hydraulic fluid disposed adjacent the rotor and the pair of rings, and one or more accessories in fluid communication with the hydraulic devices and configured to receive a hydraulic fluid pumped from the hydraulic device when operating as a vane pump.

In Example 14, the subject matter of Example 13 optionally includes an input shaft; an output shaft; and a powertrain coupled to the output shalt and receiving torque from the hydraulic device when operating as a hydraulic coupling.

In Example 15, the subject matter of Example 14 optionally includes wherein the one or more accessories comprise a hydraulic pump motor coupled to the at least one output shaft, the hydraulic pump motor including a pump motor inlet in fluid communication with the plurality of hydraulic couplings, the pump motor configured to receive fluid from one or more of the hydraulic couplings or another of the one or more of accessories to propel the output shaft.

In Example 16, the subject matter of any one or more of Examples 13-15 optionally include to 15, further comprising a controller operable to control a system operation mode based on a plurality of vehicle operation parameters.

Example 17 is a hydraulic device comprising: a pair of rings rotatably mounted within the hydraulic device and arranged adjacent one another configured for relative rotation with respect to one another, the rings having a generally elliptically shaped inner surfaces; a rotor disposed for rotation about an axis within the pair of rings, the rotor having a plurality of circumferentially spaced slots; a plurality of vanes located such that each slot has a vane located therein, the plurality of vanes configured to be movable between a retracted position and an extended position where the plurality of vanes work a hydraulic fluid introduced adjacent the rotor; and a sleeve configured to receive the rings therein and configured to translate relative to the rings, the translation causing rotatable positioning of the rings relative to one another to increase or decrease a displacement of the hydraulic fluid between the rotor and the rings.

In Example 18, the subject matter of Example 17 optionally includes wherein the sleeve has an inner surface with tracks therealong, the tracks configured to facilitate the rotatable positioning of the rings relative to one another.

In Example 19, the subject matter of Example 18 optionally includes a first bearing coupled to one of the pair of rings at an outer surface thereof and received in one of the tracks; and a second bearing coupled to a second of the pair of rings at an outer surface thereof and wherein the first bearing is received in the one of the tracks and the second bearing is received in a second of the tracks.

In Example 20, the subject matter of any one or more of Examples 17-19 optionally include wherein the sleeve has an inner surface that includes a first portion that has a helically spline with the helical spline extending in a first helical direction and includes a second portion that has a helical spline with the helical spline extending in a second helical direction generally opposed to the first helical direction, and wherein a first ring of the pair of rings has a helically splined outer surface corresponding to the helical spline of the first portion and a second of the pair of rings has a helically splined outer surface corresponding to the helical spline of the second portion.

In Example 21, the subject matter of any one or more of Examples 17-20 optionally include to 20, wherein the first of the pair of rings is rotatable n a first direction and the second of the pair rings is rotatable in a second direction opposite the first direction.

In Example 22, the subject matter of any one or more of Examples 17-21 optionally include to 21 wherein the pair of rings are selectively rotatable relative to one another between a fully registered position where the inner surfaces of the pair of rings are in-phase with one another so that the inner surfaces substantially align and a fully unregistered position where the inner surfaces of the pair of rings are out-of-phase with one another.

In Example 23, the subject matter of Example 22 optionally includes wherein positions of the pair of rings are variable with respect to one another between a fully registered position and a fully unregistered position.

In Example 24, the subject matter of any one or more of Examples optionally include to 23, further comprising: an input shaft coupled to rotate the n or an output shaft; and hydraulic fluid communication passages including an input passage configured to introduce the hydraulic fluid adjacent the rotor and an output passage configured to transport the hydraulic fluid away from the rotor; wherein the hydraulic device is operable as both a vane pump to pinup the hydraulic fluid and a hydraulic coupling to couple the input shaft with the output shaft.

In Example 25, the subject matter of Example 24 optionally includes wherein the hydraulic device is simultaneously operable as the vane pump and the hydraulic coupling with the plurality of vanes in the extended position and the pair of rings in an intermediate position between a fully registered position where the inner surfaces of the pair of rings are in-phase with one another and a fully unregistered position where the inner surfaces of the pair of rings are out-of-phase with one another.

In Example 26, the subject matter of any one or more of Examples optionally include to 25, wherein one or more fluid communicating portions the rotor and the pair of rings are coated in a diamond or diamond-like carbon.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, over the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including," and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third" etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may h grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various Combinations or permutations. The scope of the invention should be determined with reference to the appended claims, along with the full scope of equivalents to which such claims are entitled.

The claimed invention is:

1. A hydraulic device comprising:

two or more rings rotatably mounted within the hydraulic device and arranged adjacent one another configured for relative rotation with respect to one another;

a rotor disposed for rotation about an axis within the two or more rings, the rotor having a plurality of circumferentially spaced slots configured to house a plurality of vanes therein, the plurality of vanes configured to be movable between a retracted position and an extended position where the plurality of vanes work a hydraulic fluid introduced adjacent the rotor; and an adjuster configured to translate linearly to rotatably position the two or more rings relative to one another to increase or decrease a displacement of the hydraulic fluid adjacent the rotor and the two or more rings, wherein the adjuster comprises a sleeve configured to receive the two or more rings therein, the sleeve having an inner surface with one or more grooves therein, and further comprising:

a first bearing coupled to one of the two or more rings at an outer surface thereof and received in one of the one or more grooves.

2. The hydraulic device of claim 1, wherein the two or more rings are selectively rotatable relative to one another between a fully registered position where the inner surfaces of the two or more rings are in-phase with one another so that the inner surfaces substantially align and a fully unregistered position where the inner surfaces of the two or more rings are out-of-phase with one another.

3. The hydraulic device of claim 2, wherein positions of the two or more rings are variable with respect to one another between the fully registered position and the fully unregistered position.

4. The hydraulic device of claim 1, wherein the one or more grooves comprise two spaced apart grooves including the one of the two grooves helically extending in a first direction and a second of the two grooves helically extending in an opposing helical direction.

5. The hydraulic device of claim 4, further comprising a second bearing coupled to a second of the two or more rings at an outer surface thereof and wherein the first bearing is received in the one of the two grooves and the second bearing is received in the second of the two grooves.

6. The hydraulic device of claim 5, wherein the first of the two or more rings is rotatable in a first direction and the second of the two or more rings is rotatable in a second direction opposite the first direction.

7. The hydraulic device of claim 1, further comprising:

an input shaft coupled to rotate the rotor;

an output shaft; and hydraulic fluid communication passages including an input passage configured to introduce the hydraulic fluid adjacent the rotor and an output passage configured to transport the hydraulic fluid away from the rotor;

wherein the hydraulic device is operable as both a vane pump to pump the hydraulic fluid and a hydraulic coupling to couple the input shaft with the output shaft.

8. The hydraulic device of claim 7, wherein the hydraulic device is simultaneously operable as the vane pump and the hydraulic coupling with the plurality of vanes in the extended position and the two or more rings in an intermediate position between a fully registered position where the inner surfaces of the two or more rings are in-phase with one another and a fully unregistered position where the inner surfaces of the two or more rings are out-of-phase with one another.

9. The hydraulic device of claim 1, wherein one or more fluid communicating portions the rotor and the two or more rings are coated in a diamond or diamond-like carbon.

10. A hydraulic device comprising:

two or more rings rotatably mounted within the hydraulic device and arranged adjacent one another configured for relative rotation with respect to one another;

a rotor disposed for rotation about an axis within the two or more rings, the rotor having a plurality of circumferentially spaced slots configured to house a plurality of vanes therein, the plurality of vanes configured to be movable between a retracted position and an extended position where the plurality of vanes work a hydraulic fluid introduced adjacent the rotor, and an adjuster configured to translate linearly to rotatably position the two or more rings relative to one another to increase or decrease a displacement of the hydraulic fluid adjacent the rotor and the two or more rings, wherein the adjuster includes an inner surface that is splined and is configured to mate with a corresponding splined outer surface of the two or more rings.

11. The hydraulic device of claim 10, wherein the inner surface includes a first portion that has a helically spline with the helical spline extending in a first helical direction and includes a second portion that has a helical spline with the helical spline extending in a second helical direction generally opposed to the first helical direction, and wherein a first ring of the two or more rings has a helically splined outer surface corresponding to the helical spline of the first portion and a second ring of the two or more rings has a helically splined outer surface corresponding to the helical spline of the second portion.

12. A hydraulic device comprising:

a pair of rings rotatably mounted within the hydraulic device and arranged adjacent one another configured for relative rotation with respect to one another, the rings having a generally elliptically shaped inner surfaces;

a rotor disposed for rotation about an axis within the pair of rings, the rotor having a plurality of circumferentially spaced slots;

a plurality of vanes located such that each slot has a vane located therein, the plurality of vanes configured to be movable between a retracted position and an extended position where the plurality of vanes work a hydraulic fluid introduced adjacent the rotor; and a sleeve configured to receive the rings therein and configured to translate relative to the rings, the translation causing rotatable positioning of the rings relative to one another to increase or decrease a displacement of the hydraulic fluid between the rotor and the rings.

13. The hydraulic device of claim 12, wherein the sleeve has an inner surface with tracks therealong, the tracks configured to facilitate the rotatable positioning of the rings relative to one another.

14. The hydraulic device of claim 13, further comprising:

a first bearing coupled to one of the pair of rings at an outer surface thereof and received in one of the tracks; and a second bearing coupled to a second of the pair of rings at an outer surface thereof and wherein the first bearing is received in the one of the tracks and the second bearing is received in a second of the tracks.

15. The hydraulic device of claim 12, wherein the sleeve has an inner surface that includes a first portion that has a helically spline with the helical spline extending in a first helical direction and includes a second portion that has a helical spline with the helical spline extending in a second helical direction generally opposed to the first helical direction, and wherein a first ring of the pair of rings has a helically splined outer surface corresponding to the helical spline of the first portion and a second of the pair of rings has a helically splined outer surface corresponding to the helical spline of the second portion.

16. The hydraulic device of claim 12, wherein the first of the pair of rings is rotatable in a first direction and the second of the pair rings is rotatable in a second direction opposite the first direction.

17. The hydraulic device of claim 12, wherein the pair of rings are selectively rotatable relative to one another between a fully registered position where the inner surfaces of the pair of rings are in-phase with one another so that the inner surfaces substantially align and a fully unregistered position where the inner surfaces of the pair of rings are out-of-phase with one another.

18. The hydraulic device of claim 17, wherein positions of the pair of rings are variable with respect to one another between a fully registered position and a fully unregistered position.

19. The hydraulic device of claim 12, further comprising:

an input shaft coupled to rotate the rotor;

an output shaft; and hydraulic fluid communication passages including an input passage configured to introduce the hydraulic fluid adjacent the rotor and an output passage configured to transport the hydraulic fluid away from the rotor;

wherein the hydraulic device is operable as both a vane pump to pump the hydraulic fluid and a hydraulic coupling to couple the input shaft with the output shaft.

20. The hydraulic device of claim 19, wherein the hydraulic device is simultaneously operable as the vane pump and the hydraulic coupling with the plurality of vanes in the extended position and the pair of rings in an intermediate position between a fully registered position where the inner surfaces of the pair of rings are in-phase with one another and a fully unregistered position where the inner surfaces of the pair of rings are out-of-phase with one another.

21. The hydraulic device of claim 12, wherein one or more fluid communicating portions the rotor and the pair of rings are coated in a diamond or diamond-like carbon.

* * * * *